US006438331B2

(12) United States Patent
Sakaizawa et al.

(10) Patent No.: US 6,438,331 B2
(45) Date of Patent: Aug. 20, 2002

(54) IMAGE FORMING APPARATUS WITH CLEANING SEQUENCE OF CONTACT CHARGING MEMBERS

(75) Inventors: Katsuhiro Sakaizawa, Numazu; Manami Sekiguchi, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/741,020

(22) Filed: Dec. 21, 2000

(30) Foreign Application Priority Data

Dec. 27, 1999 (JP) ..... 11-371478
Dec. 27, 1999 (JP) ..... 11-371479

(51) Int. Cl.[7] ..... G03G 15/00
(52) U.S. Cl. ..... 399/50; 399/149
(58) Field of Search ..... 399/38, 46, 50, 399/149, 174, 175, 176

(56) References Cited

U.S. PATENT DOCUMENTS 5,235,386 A * 8/1993 Yano et al. ..... 399/111
5,701,568 A * 12/1997 Hiroshima et al. ..... 399/302
5,970,279 A * 10/1999 Sakaizawa et al. ..... 399/46
6,006,055 A * 12/1999 Furuya ..... 399/149

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

The present invention provides an image forming apparatus, which has an image bearing body for bearing a toner image, transferring device for transferring a toner image on the image bearing body to a transferring material, a charging member for charging the image bearing body, having a residual toner after the transfer on a surface thereof by being brought into contact therewith, electrostatic image forming device for forming an electrostatic image on the image bearing body charged by the charging member, developing device for collecting the residual toner on the image bearing body while developing the electrostatic image on the image bearing body by using a toner charged in the same polarity as a charging polarity generated by the charging member, control device for controlling a voltage to be applied to the charging member, and a cleaning sequence for performing a cleaning of the charging member by applying a voltage not higher than a discharge threshold and equal to the polarity of the toner after a discharge voltage reverse to the polarity of the toner is applied onto the charging member, when an image formation is not effected.

25 Claims, 13 Drawing Sheets

IMAGE FORMING APPARATUS WITH CLEANING SEQUENCE OF CONTACT CHARGING MEMBERS

BACKGROUND OF THE INVENTION

1. Field of the Invention

The present invention relates to an image forming apparatus of a copier, a printer or the like, using an electrophotographic method or an electrostatic recording method.

2. Related Background Art

In recent years, attention has been attracted to an image forming apparatus of a cleaning simultaneous with developing type, free from waste toner.

FIG. 6 shows a schematic configuration of one example of image forming apparatus of the cleaning simultaneous with developing type in the contact development using nonmagnetic unicomponent toner.

As shown in FIG. 6, this type of image forming apparatus conventionally comprises a photosensitive drum (image bearing body) 101 rotating along an arrow X as well as a charging roller (primary charger) 102, an exposing tool 103, a developing device 104 and a transferring roller (transferring charger) 105 disposed around the photosensitive drum 101. Besides, downstream of the transferring roller 105 along the conveying direction (along the arrow Kp) of the transferring material P, a fixing device 107 is disposed.

The developing device 104 comprises a developing roller 108 provided in contact with the photosensitive drum 101 for performing the development while rotating along the arrow Y, a supply roller (developer supply means) 109 for supplying a nonmagnetic toner T to the developing roller 108 by the rotation along the arrow Z, a regulating blade (developer regulation means) 110 for regulating the applied amount and the charged amount of the toner T on the developing roller 108 and a agitating member 111 for supplying a toner T to the supply roller 109 and simultaneously agitating the nonmagnetic unicomponent toner. The toner T is a negative polarity toner and a process of sticking this toner T to the exposed portion or a so-called reversal development is performed.

The image forming operation of the above-constructed image forming apparatus will be described below.

In response to an external print signal (image forming signal), the photosensitive drum 101 begins to rotate along the arrow X. First, the surface of the photosensitive drum 101 is charged uniformly by the charging roller 102. The charging roller 102 has the shape of a roller and is rotated by driving means (unillustrated) along the arrow W. Next, an exposure L by means of the exposing tool 103 causes an electrostatic latent image on the photosensitive drum 101 and the electrostatic latent image arrives at the contact part of the developing device 104 by the rotation of the photosensitive drum 101.

In linkage with the above operation, the developing device 104 performs the following operation.

By the sliding friction of the supply roller 109 rotating along an arrow Z and the developing roller 108 rotating along the arrow Y, the toner T agitated by means of the agitating member 111 is supplied onto the developing roller 108. The toner on the developing roller 108, which is given a desired charging amount while the quantity (layer thickness) of the toner is regulated, is carried on the developing roller 108. Besides, the toner in the developing device 104 is agitated by means of the agitating member 111 and carried to the supply roller 109.

When the toner T carried on the developing roller 108 reaches the location in contact with the photosensitive drum 101, a DC development bias is applied to the developing roller 108 by a power supply (unillustrated). Thereby, the toner T carried on the surface of the developing roller 108 is stuck thereto, so that the electrostatic latent image formed on the surface of the developing drum 101 is developed (visualized) as a toner image. At this time, the toner remaining on the surface of the developing roller 108 without contribution to the development is collected into the developing device 104 via the supply roller 109.

In a contact developing unit using a rigid photosensitive drum 101 to perform the cleaning simultaneously with the development under contact with the developing roller 108, the developing roller 108 is desirably a roller made by forming an elastic body into the shape of a roller. Used as this elastic body are those subjected to the resin coating on a solid rubber monolayer or a solid rubber in view of the toner charging property.

Besides, to execute a contact development, a method of using a rigid developing roller to a belt-shaped photosensitive belt is also available in addition to a method of abutting an elastic developing roller 108 against a rigid photosensitive drum 108.

The toner on a photosensitive roller 101 reaches the opposed part of a transferring roller 105 by the rotation of the photosensitive drum 101 and is transferred to a transferring material P by the transferring roller 105. The transferring material P after the transfer of a toner image is conveyed in a direction of the arrow Kp and discharged outside the image forming apparatus after the thermal melting and fixation of the surface toner image by means of the fixing device 107.

On the other hand, the toner remaining (transfer residual toner) on the photosensitive drum 101 without being transferred onto the transferring material P at the time of transfer, passes through the charging roller 102 and reaches the abutting part against the developing roller 108. At this time, the residual toner is collected onto the developing roller 108 under action of a DC developing bias applied to the developing roller 108 and this collected toner is to be supplied to the development at the next image forming.

By repeating the above operation, the image forming of the cleaning simultaneous with developing type is repeated.

In the image forming apparatus of the cleaning simultaneous with developing type shown in the above conventional example, however, there was a problem that a toner had been stuck to the charging roller 102 by long-term use, thus resulting in poor charging. The cause of this is considered as follows.

The image forming apparatus of the cleaning simultaneous with developing type collects the transfer residual toner remaining on the photosensitive drum 101 without being transferred to the transferring material P by means of the developing device 104.

Accordingly, the transfer residual toner has to pass through the charging roller 102. The transfer residual toner at the moment of having passed through the transferring roller 105, however, is a toner comprising the mixing of positive and negative polarities or a broad distribution of rather positive polarity under the influence of a positive polarity transferring bias. Thus, it cannot pass through the charging roller 102 and ends in being stuck thereto for the following reason.

FIGS. 7A and 7B are illustrations of the behavior of the toner near the charging roller 102. As shown in FIGS. 7A and 7B, the transfer residual toner at the moment of having passed through the transferring roller 105 arrives near the charging roller 102 with the mixing of positive and negative polarities or a broad distribution of rather positive polarity, under influence of a positive polarity transferring bias. Here, applied to the charging roller 102 from a charging bias power supply 112 is a negative polarity DC charging bias. And, near the nip part between the charging roller 102 and the photosensitive drum 101, a discharge area is formed by this DC charging bias (B area in FIG. 7A).

Because of mostly comprising a positive polarity toner charged oppositely to the normal polarity, or a so-called reverse toner, the toner having arrived near the charging roller 102 (A area of FIG. 7A) ends in being attracted to the charging roller 102 by the electric field acting between the charging roller 102 and the photosensitive drum 101.

The transfer residual toner stuck to the charging roller 102 enters the B area of a discharge area with the rotation of the charging roller 102. There, as shown in FIG. 7B of an enlarged view of the B area in FIG. 7A, positive and negative charges are generated as a result of discharge, while negative charges are attracted to the side of the photosensitive drum 101 and contributes to charging the surface of the photosensitive drum 101. Besides, positive charges generated at the same time are attracted to the side of the charging roller 102. At this time, since the transfer residual toner is present on the surface of the charging roller 102, the transfer residual toner has grown to be more and more positively charged by sticking of positive charges.

And, even if passing through the nip part and the downstream discharge area, the positively charged transfer residual toner remains stuck to the charging roller 102 and ends in being attracted to the charging roller 102 by the electric field acting between the charging roller 102 and the photosensitive drum 101.

After one turn of the charging roller 102, the toner stuck to the charging roller 102 enters the B region again as it proceeds and is recharged because of being positively charged. Furthermore, a new transfer residual toner brought on with the rotation of the photosensitive roller 101 is further stacked over the toner layer stuck already to the charging roller 102 and charged positively by discharge near the charging roller 102 in a similar manner to the above-mentioned. Like this, the toner stuck to the charging roller 102 is charged still more intensively and at the same time a transfer residual toner is stacked.

As a result, toners are stacked on the charging roller 102 in several layers, so that the photosensitive drum 101 cannot be charged to a normal surface potential and poor charging takes place.

To prevent the poor charging, there has been proposed a method for negatively charging a toner by using an auxiliary material such as toner charging member formed of a brush, a sponge or the like between the transfer roller 105 and the charging 102 so as to negatively charge the toner stuck onto the photosensitive roller 101 immediately after the transfer process.

However, this method had a problem of bringing about a rise in the cost and a lack of stability.

SUMMARY OF THE INVENTION

It is an object of the present invention to provide an image forming apparatus using the cleanerless method and the contact charging method.

It is another object of the present invention to provide an image forming apparatus eliminating the occurrence of poor charging.

It is still another object of the present invention to provide an image forming apparatus enabling the toner stuck to a charging member to be transferred to an image bearing body under action of an electric field.

It is yet another object of the present invention to provide an image forming apparatus comprising: an image bearing body for bearing a toner image; transferring means for transferring a toner image on the image bearing body to a transferring material; a charging member for charging the image bearing body having a residual toner after the transfer on a surface thereof by being brought into contact therewith; electrostatic image forming means for forming an electrostatic image on the image bearing body charged by the charging member; developing means for collecting the residual toner on image bearing body while developing an electrostatic image on the image bearing body by using a toner charged in the same polarity as a charging polarity generated by the charging member; control means for controlling a voltage to be applied to the charging member; and a cleaning sequence for performing the cleaning of the charging member by applying a voltage not higher than a discharge threshold and equal to the polarity of the toner after the application of a discharge voltage reverse to the polarity of the toner is applied onto the charging member, when an image formation is not effected.

Further another objects of the present invention would be disclosed in the following description.

DESCRIPTION OF THE PREFERRED EMBODIMENTS

Figure 1:
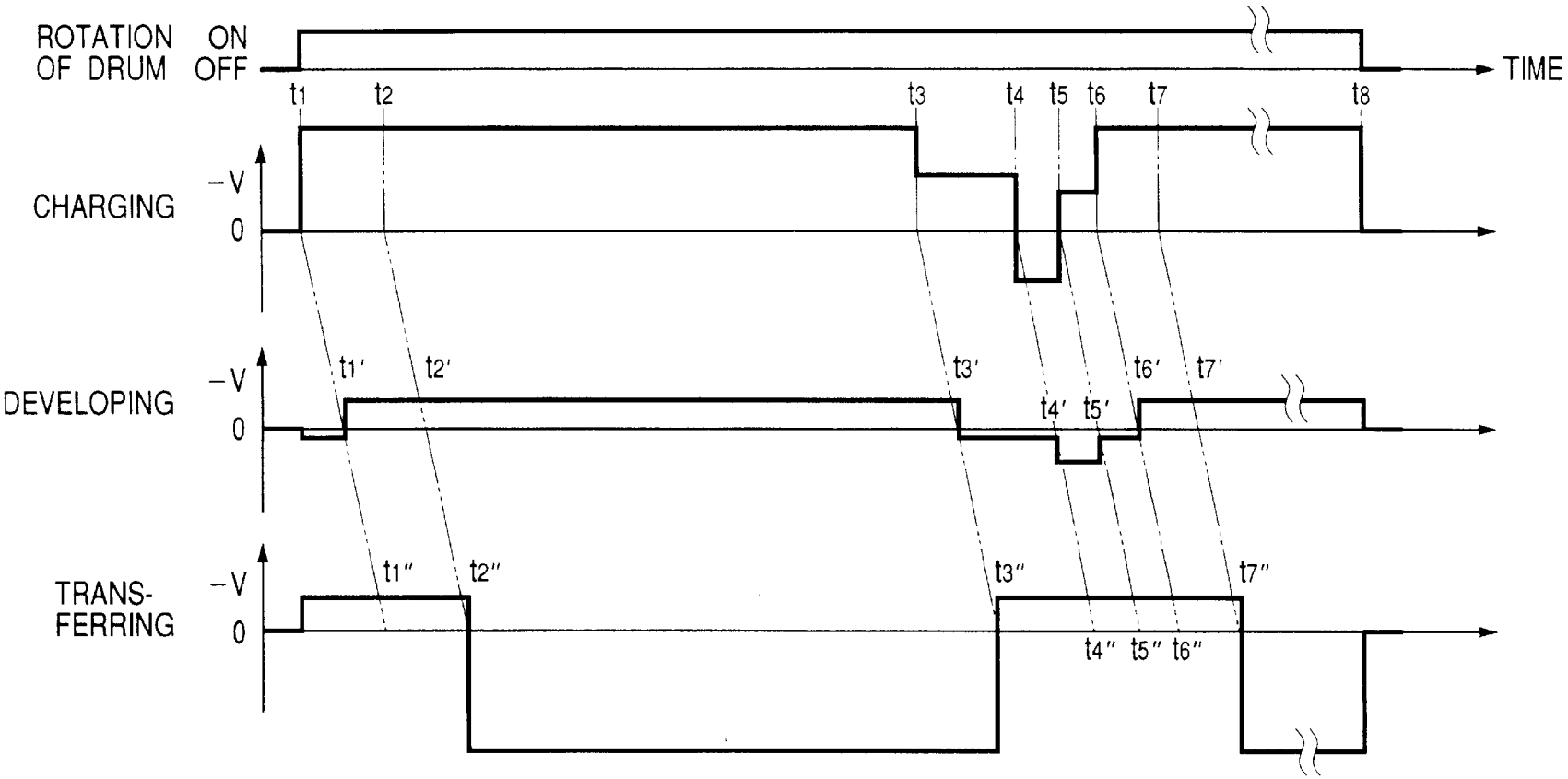
FIG. 1 is a graph showing a control sequence according to First Embodiment.

Referring to the drawings, embodiments of the present invention will be described below.

<First Embodiment>

FIG. 1 is a graph showing a control sequence in case of using an image forming apparatus according to First Embodiment. Incidentally, the control sequence will be described in details later.

In an image forming apparatus of a cleaning simultaneous with developing type using a contact charging member, the present invention charges transfer residual toner stuck to a charging member at a negative polarity and ejects it from the charging material by applying a bias to the charging member which is opposed in polarity to the toner above a discharge threshold at a non-image formation and then applying a bias equal in polarity to the toner not higher than the discharge threshold.

Figure 2:
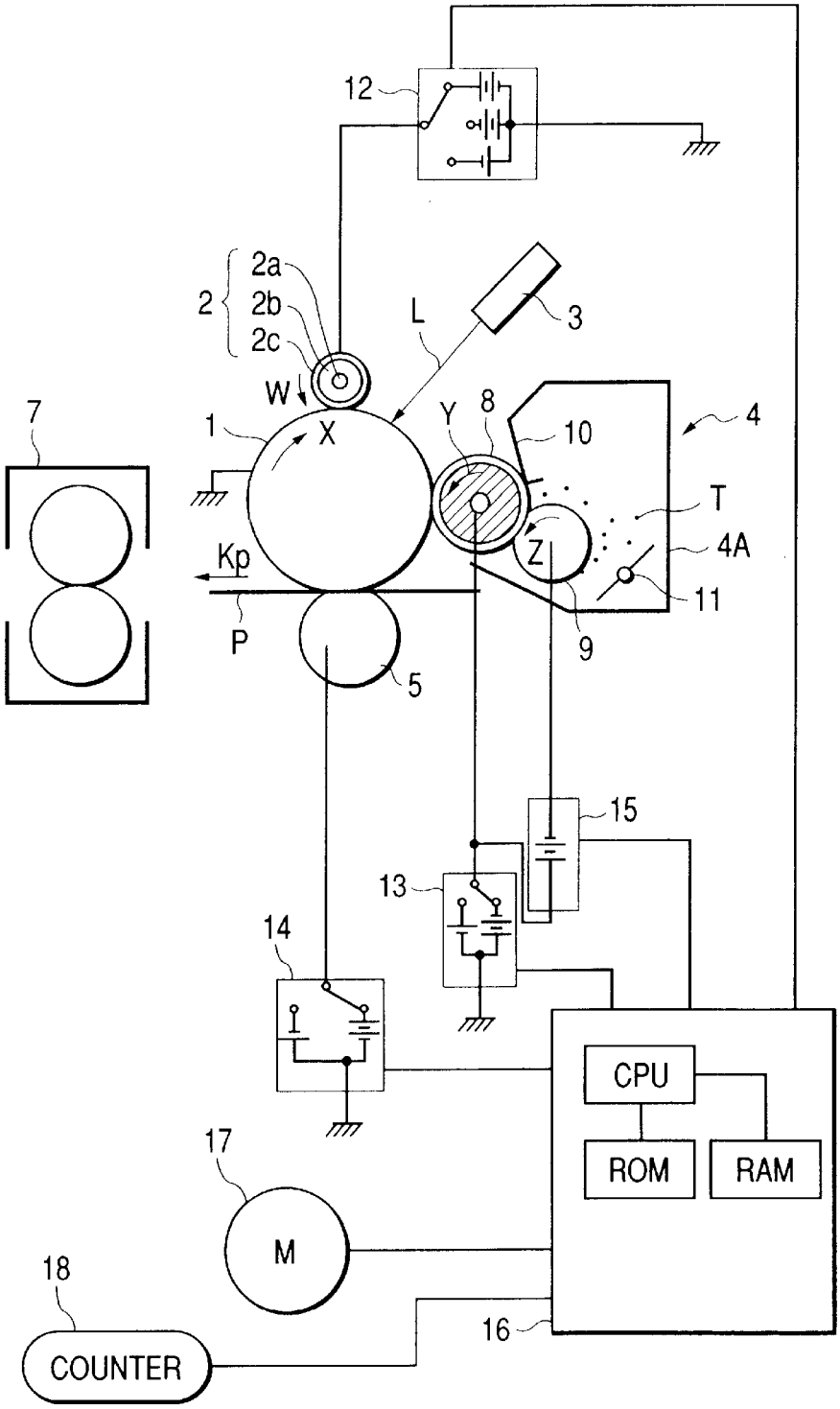
FIG. 2 is a diagram showing a schematic configuration of an image forming apparatus according to First Embodiment.

FIG. 2 shows one example of an image forming apparatus according to the present invention. The image forming apparatus shown in FIG. 2 is an image forming apparatus (i.e. copier or laser beam printer) of the cleaning simultaneous with developing type and FIG. 2 is a vertically sectional view showing its schematic construction.

First, the schematic configuration and the schematic operation over a whole image forming apparatus will be described.

The image forming apparatus shown in FIG. 2 is equipped with a drum-shaped electrophotographic photosensitive body (hereinafter, referred to as "photosensitive drum") 1 as the image bearing body. Around the photosensitive drum 1, a charging roller (primary charger) 2 as charging means, an exposing tool 3 as exposing means, a developing device (developing device) 4 as developing means and a transferring roller (transferring member) 5 as transferring means are disposed almost in sequence along its rotating direction (direction of the arrow X), while a fixing device 7 as fixing means is disposed downstream of the transferring roller 5 along the conveying direction (direction of the arrow Kp) of a transferring material P such as paper. In the image forming apparatus shown in FIG. 2, the toner (transfer residual toner) remaining on the surface of the photosensitive drum 1 without being transferred to the transferring material P at the transfer passes through the charging roller 2 and is collected by the developing device 4.

As shown in FIG. 2, the charging roller 2 uniformly charges the photosensitive roller 1 rotating in the direction of the arrow X to a given polarity and a given potential while rotating in the direction of the arrow W. And, the surface of the photosensitive drum 1 after the charging is subjected to the exposure L in response to an information signal by means of the exposing tool 3 having the light-emitting element of a laser or LED to form an electrostatic latent image. This latent image is developed (visualized) as a toner image by means of the developing device 4 with a toner stuck thereto. By means of the transferring roller 5, this toner image is transferred to the transferring material P conveyed by fed conveying means (unillustrated). The transferring material P after the transfer of a toner image is conveyed to the fixing device 7 and heated/pressurized here, so that the toner is fixed onto its surface. On the other hand, in the photosensitive drum 1 after the transfer of a toner image, the transfer residual toner remaining on its surface without being transferred to the transferring material P is collected by the developing roller 8 of the developing device 4 after the passage through the charging roller 2.

With these, the sketchy description of the configuration and the operation of an image forming apparatus shall finish. Subsequently, individual members will be described in details.

The photosensitive drum 1 shown in FIG. 2 is rotated at a peripheral speed of $V_X$ along the arrow X by driving means (unillustrated). In this embodiment, $V_X$ was set to 48 mm/sec. The diameter of the photosensitive drum 1 was set to 30 mm.

The charging roller 2 is a contact charging roller for performing the charging in contact with the photosensitive drum 1, which is rotationally driven along the arrow W at the same speed as with the photosensitive roller 1. To the charging roller 2, a charging bias power supply 12 is connected so as to uniformly charge the surface of the photosensitive roller 1. During the image forming operation, the charging bias power supply 12 applies a bias of approx. −1100 V to the charging roller 2 to uniform charge the surface of the photosensitive roller 1 to approx. −500 V.

With the charging roller 2 used in the present embodiment, a low resistance conductive rubber layer **2*b* on the order of $10^4$ Ω·cm in bulk resistivity was formed at a thickness of 3 mm on the outside peripheral surface of a 6 mm diameter mandrel made of a conductive metal and further a high resistance layer 2*c* on the order of $10^8$ Ω·cm in bulk resistivity was formed at a thickness of 20 to 50 μm on the outside peripheral surface thereof. The diameter of the charging roller 2** totaled 12 mm thickness.

Next, by using an light-emitting element (such laser or LED) face of the developing device 3, the surface of the photosensitive drum 1 is exposed and scanned in response to an information signal to form an electrostatic latent image. In this embodiment, the so-called reversal developing system for sticking a negatively charged toner to the exposed portion on the photosensitive drum 1 to form a toner image will be described, but the present invention is not limited to this.

The developing device 4 is equipped with a developing container 4A for accommodating a nonmagnetic unicomponent toner T (hereinafter, properly referred to as "toner T" simply). The developing container 4A comprises an opening provided opposite the photosensitive drum 1. At the opening, a developing roller (developer carrying body) 8 is disposed. The developing roller 8 is in contact with the photosensitive drum 1 and rotates along the arrow Y at a speed of $V_Y$. The developing device 4 further comprises a regulating blade 10 as the toner regulating member, a supply roller 9 rotating along the arrow Z and an agitating member 11 for agitating a toner T. Here, the relation between the peripheral speed $V_X$ of the photosensitive drum 1 and the peripheral speed $V_Y$ of the developing roller 8 satisfies $V_X<V_Y$. That $V_Y$ of the developing roller 8 is set to 81 mm/sec.

To stick the toner T contained in the developing container 4A to the developing roller 8, the toner T must be rubbed with the supply roller 9 and the developing roller 8 to apply the charge. For the supply roller 9, a publicly-known material such as foamed urethane rubber or foamed EPDM rubber is available. In this embodiment, a supply roller 9 made of foamed urethane rubber is rotated at a peripheral speed of $V_Z$ in the counter direction (direction of the arrow Z) to the rotating direction (direction of the arrow Y) of the developing roller 8. As the rotating speed, $V_Z$ is 40 mm/sec. To the supply roller 9, a supply bias power source 15 is connected and a DC voltage of approx. −460 V is applied to energize a negative polarity charged toner T from the supply roller 9 to the developing roller 8.

To the toner coated onto the developing roller 8 by means of the supply roller 9, the regulation of the toner amount and applying of the tribo-electricity by the friction are performed with the regulating blade 10. The regulating blade 10 is made by bending a stainless steel sheet (about 0.1 mm thick) at the position approx. 2 mm apart from the tip in the opposite direction to the developing roller 8 and the bent part is so disposed as to be in a little encroaching contact with the developing roller 8.

Besides, connected to the developing roller 8 is a developing bias power supply 13 and the photosensitive drum 1 is grounded. The developing bias power supply 13 is a negative polarity DC power supply and applies a potential of −350 V as the developing bias during the of image formation in First Embodiment. The toner with charges afforded through the regulating blade 10, carried on the developing roller 8, is supplied onto the photosensitive drum 1 under action of the above developing bias (−350 V) and stuck to the electrostatic latent image, then this electrostatic latent image is developed as a toner image.

The toner image formed on the surface of the above photosensitive drum 1 is transferred to a transferring material P. The transferring material P is fed to a transferring part formed between the photosensitive drum 1 and the transferring roller 5 by means of a feed carrying device, e.g. comprising a sheet feed cassette, sheet feed roller, conveying roller, registration roller and so on (every unillustrated). The transferring material P is fed to the transferring part so as to conform to the timing of the toner image on the surface of the photosensitive drum 1, and the toner image on the photosensitive drum 1 is transferred by the transferring roller 5. In this embodiment, the transferring roller 5 is a roller-type transfer charging tool and the transfer bias power supply 14 is connected to this. To the developing roller 5, a voltage of approx. 1 to 4 kV is applied during the image formation by the transfer bias power supply 14.

The application timing of the charging bias power supply 12, the developing bias power supply 13, the supply bias power supply 15 and a transfer bias power supply 14 mentioned above is controlled by a controller (control means) 16.

Besides, the rotating operation of the photosensitive drum 1, the charging roller 2, the developing roller 3, the transferring roller 5, the fixing device 7 and so on is carried out by the transmission of the motive force from a main motor 17 via gears or the like.

The transferring material P with a toner image transferred thereto is carried to the developing device 7 and heated/pressurized there, so that the toner is thermally fused (fixed) onto the surface.

On the other hand, the transfer residual toner remaining on the surface of the photosensitive roller 1 without transferred onto the transferring material P reaches the charging roller 2. The transfer residual toner having reached the charging roller 2 has normally undergone a discharge caused by the transferring roller 5 and consequently is charged at the polarity reverse to the normal charging polarity.

The transfer residual toner charged at the reverse polarity is charged at the positive polarity by a discharge between the charging roller 2 and the photosensitive drum 1 and is stuck onto the charging roller 2.

Next, the ejecting operation of a toner from the charging roller 2, which is the feature of this embodiment, will be described referring to FIG. 1.

FIG. 1 shows a control sequence for the charging potential (charging bias) in the charging part, the developing potential (developing bias) in the developing portion and the transferring potential (transferring bias) in the transferring part. Here, the axis of ordinates in each part represents the polarity of the applied voltage and the negative polarity is taken upward. The axis of abscissas is employed the time axis. The two-dot chain line over the charging, the developing and the transfer represents the respective identical points on the photosensitive drum 1. And, time $t_1'$ is specified when the position on the surface of the photosensitive drum 1 situated at the nip part with the charging roller 2 at time $t_1$ came opposite the developing roller 8 after a lapse of time, while time $t_1''$ is specified when the position on the surface of the photosensitive drum 1 situated at the nip part with the charging roller 2 similarly at time $t_1$ came opposite the transfer roller 5 after a lapse of time.

First, an image signal is inputted to the image forming apparatus from a computer (unillustrated) or the like and the photosensitive drum 1 begins to rotate by the rotation of the main motor 17 (time $t_1$). Simultaneously to this, a charging bias (−1100 V) similar to that of the time of image formation is applied from the charging bias power supply 12. The period from time $t_1$ to time $t_2$ is a preparatory rotation before the image formation (hereinafter, referred to as "ante-rotation") and the temperature of the fixing device 7 and the startup of a laser scanner are performed during this period.

In the developing bias power supply 13, a bias of approx. 100 V is applied to the developing roller 8 at time $t_1$. This is because there is a time of the surface potential dropping near zero on account of the dark dissipation of the photosensitive drum 1 during a period from the charging drum 2 to the developing roller 8 and the toner on the developing roller 8 is inevitably developed if the surface potential is zero and a developing bias of 0 V is applied.

At time $t_1'$, a bias of −350 V is applied from the developing bias power supply 13. At this time, since the surface of the photosensitive drum 1 is already charged to approx. −500 V, the toner carried on the developing roller 8 is not in the least possible to be developed.

And, applied to the transferring roller 5 is a negative polarity bias as the cleaning bias. This bias is on the order of approx. −400 V and applied to remove the toner pollution on the transferring roller 5.

When the pre-rotation finishes at time $t_2$, the duration from time $t_2$ to time $t_3$ corresponds to the image forming time. Namely, from time $t_2$ on, the surface of the photosensitive drum 1 is exposed in accordance with an image signal, and the image formation is carried out as mentioned above. At the image formation, as mentioned in a conventional example, the transfer residual toner is generated little by little and is accumulated on the charging roller 2.

At time $t_3$, the image formation ends. And, since the next image formation begins at time $t_7$, a period from time $t_3$ to time $t_7$ corresponds to a so-called "sheet interval" between the prior image formation and the next image formation in the case of continuous image formation (continuous printing).

Between time $t_3$ and time $t_4$, the potential of the surface of the photosensitive drum 1 is not stable because the photosensitive drum 1 was subjected to a discharge by the transferring roller 5 at the time of pre-rotation. Thus, between time $t_3$ and time $t_4$, the surface of the photosensitive drum 1 is charged to approx. −100 V by the application of approx. −700 V from the charging bias power supply 12.

At that time, to the developing roller 8, a bias of approx. +100 V is applied from the developing bias power supply 13. Thereby, there is not the least possibility that the toner carried on the developing roller 8 is developed to the photosensitive drum 1 (time $t_3'$ to time $t_4'$).

When the image formation is completed, with respect to the transferring bias, the similar bias at the time of the pre-rotation is continued to be applied by time $t_7$ (time $t_3''$ to time $t_7''$).

Figure 3A:
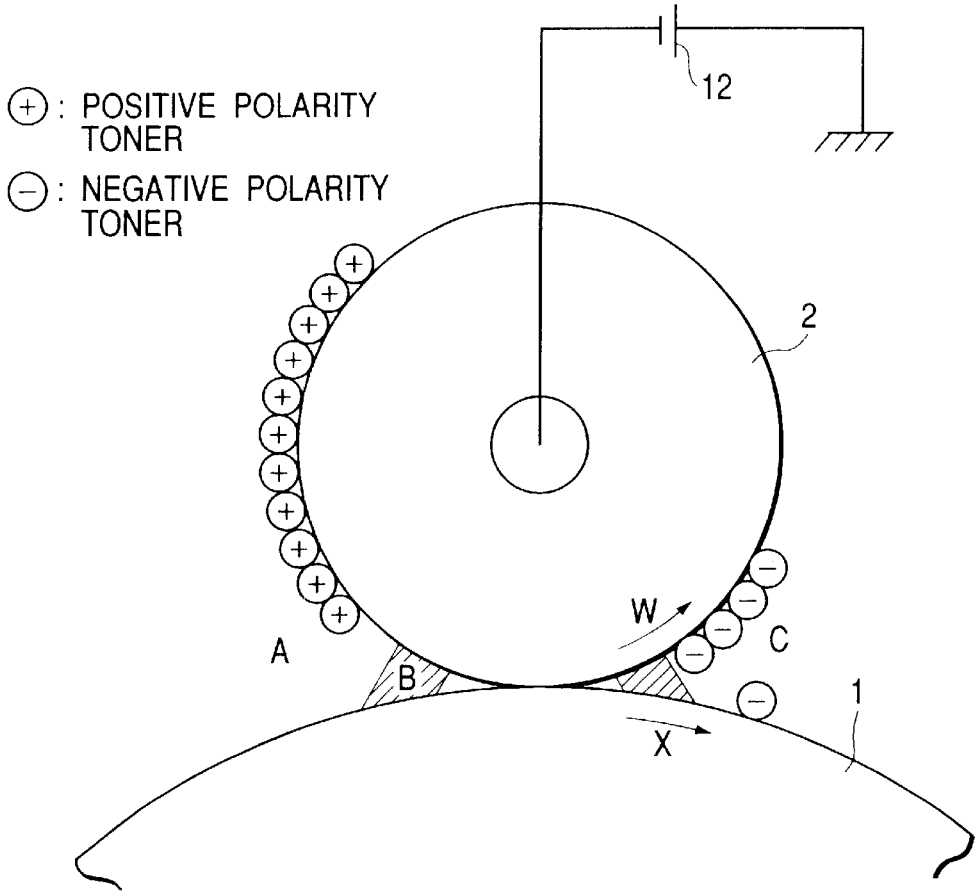
FIGS. 3A and 3B are illustrations of a polarity reversal of a toner stuck to a charging roller.
Figure 3B:
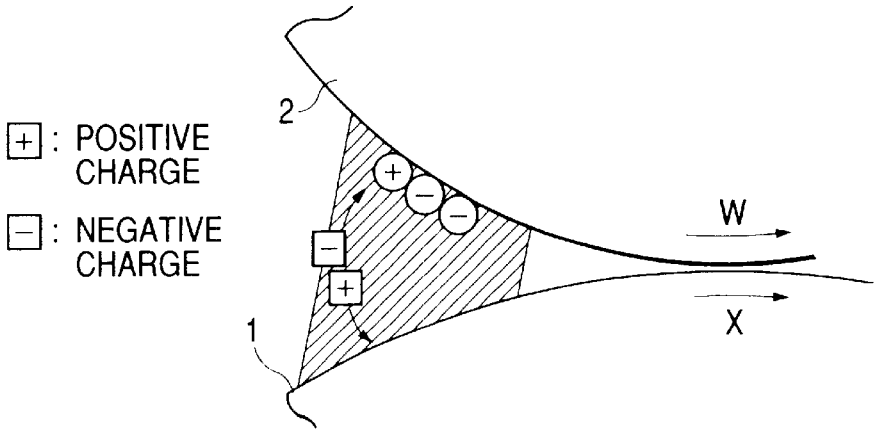

The process from time $t_4$ to time $t_6$ is provided for the toner ejection from the charging roller 2, a characteristic part of the present invention. This process will be described using FIG. 3. First, between time $t_4$ and time $t_5$, a positive polarity voltage beyond the discharge threshold in opposition to the charging polarity of the toner is applied from the charging bias power supply 12. In this embodiment, a voltage of +700 V was applied. In FIG. 3A, the positive polarity toner stuck to the charging roller 2 is in a state of being charged at a strong positive polarity because of being already subjected to a plus discharge between the charging roller 2 and the photosensitive drum 1. As a result of an increase in the sticking power of the toner, toner comes into the discharge area B without transferred to the photosensitive drum 1 even if entering the preceding area A to the discharge area B. In this discharge area B, the positive polarity toner undergoes a minus discharge and is charged into the negative polarity (FIG. 3B).

In the present invention, the discharge threshold means a point where the flowing current changes drastically when gradually raising the voltage applied to the charging roller 2. This discharge threshold is generally on the order of approx. 600 V at a normal temperature and a normal humidity.

The toner passing through the discharge area B and entering the region C is attracted to the charging roller 2 by an electric field and rotates while stuck to the charging roller 2.

At time $t_5$, the toner charged to the negative polarity at time $t_4$ comes between the charging roller 2 and the photosensitive drum 1. At this time, the bias applied from the charging bias power supply 12 to the charging roller 2 is set to a negative polarity voltage allowing no negative polarity discharge. In this embodiment, a bias of −300 V is applied. Since the surface of the photosensitive drum 1 is charged to approx. −100 V between time $t_3$ and $t_4$, the negative polarity toner stuck to the charging roller 2 is transferred onto the photosensitive drum 1 by applying a bias of −300 V to the charging roller 2 during time $t_5$ to time $t_6$.

At this time, the presence of a voltage difference from the photosensitive drum 1 is preferably not smaller than 50 V as the lower limit of a bias to be applied to the charging roller 2, or in other words, a voltage not smaller than −150 V is preferably applied if the surface potential of the photosensitive drum 1 is −100 V. This is because, if the voltage difference is not more than 50 V, no electric field for ejecting a sufficient toner can be formed, thus entailing a residual toner remaining on the charging roller 2.

Corresponding to these operations, a voltage of +500 V is applied to the developing roller 8 from the developing bias power supply 13 (time $t_4'$ to time $t_5'$). Even if a voltage of +500 V is applied, the toner on the developing roller 8 is not in the least possible to be developed onto the photosensitive drum 1, because the surface of the photosensitive drum 1 has a surface potential of approx. +100 V on account of a discharge in the charging process (time $t_4$ to time $t_5$).

And, the negative polarity toner ejected from the charging roller 2 to the photosensitive drum 1 from time $t_5$ to time $t_6$ in the charging part arrives at the butt contact part against the developing roller 8 (time $t_5'$ to time $t_6'$). Since no discharge takes place in the charging part between time $t_5$ and time $t_6$, the photosensitive drum 1 arrives while the surface potential thereon is kept at −100 V charged between time $t_3$ and time $t_4$. For a period from time $t_5'$ to time $t_6'$, application of +100 V to the developing roller 8 enables the negative polarity toner to be collected at the side of the developing roller 8.

The period from time $t_6$ to time $t_7$ is a preparatory period for entering the next image formation and the charging bias is modified to an applied bias (approx. −1100 V) at the time of a normal image formation during this period. Similarly, during a period from time $t_6'$ to time $t_7'$, the developing bias is also modified to an applied bias (approx. −350 V) at the time of a normal image formation.

And, from time $t_7$ on, the next image formation proceeds and the image formation ends at time $t_8$.

In this embodiment, the transfer residual toner was ejected at the "sheet interval" between the first transferring material P and the second transferring material P, but the present invention is not limited to this. As shown in FIG. 2, for example, the output counter 18 may be provided to execute the ejection process of a toner from the charging roller 2 for every number of given sheets.

Furthermore, the ejection of the transfer residual toner from the charging roller 2 was accomplished at the "sheet interval" during the continuous printing operation of the present invention may be carried out after the above pre-rotation process or after the completion of image formation.

Besides, by having photosensitive drum surface potential stabilizing means using a pre-charging exposing tool or the like provided between the transferring roller 5 and the charging roller 2 or by detecting the surface potential by surface potential detecting means or the like, the period from time $t_3$ to time $t_4$ may be shortened.

As described concerning the charging roller 2 also in the contact type, the present invention is not limited to these, but is applicable to such a shape as brush charger.

As mentioned above, by forming a discharge electric field at the polarity reverse to the charging polarity on the charging roller 2 at the time of non-image formation, the polarity of the transfer residual toner stuck onto the charging roller 2 is reversed, then the toner is transferred to the photosensitive drum 1 by forming an electric field not greater than the discharge threshold equal in polarity to the toner. Thereby, the transfer residual toner stuck to the charging roller 2 can be removed stably, thus enabling a faulty image due to poor charging to be prevented.

<Second Embodiment>

Figure 4:
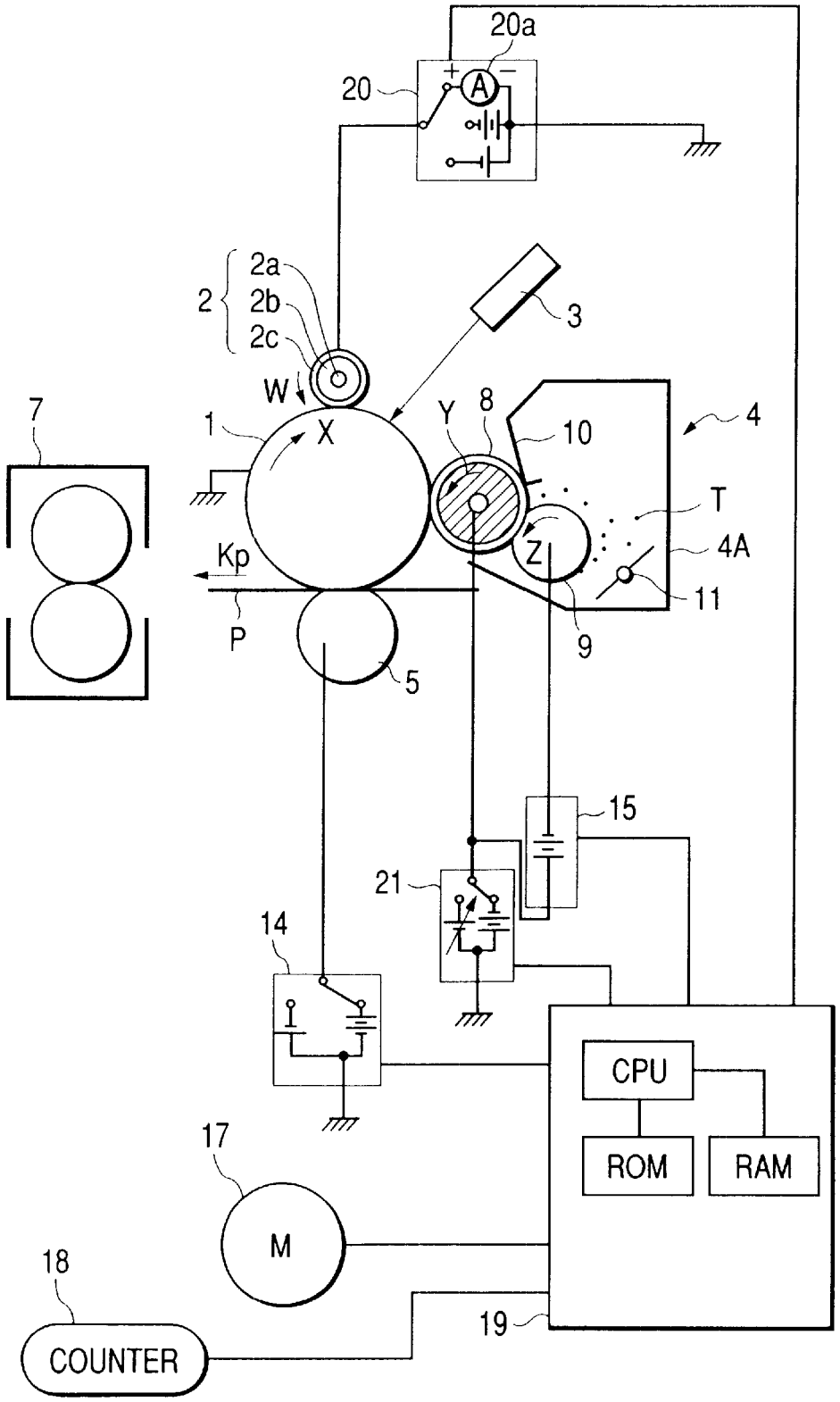
FIG. 4 is a diagram showing a schematic configuration of an image forming apparatus according to Second Embodiment.

Referring to FIG. 4, a Second Embodiment will be described. Incidentally, by attaching like symbols to members or the like of a configuration/action similar to that of First Embodiment, the duplicate description shall be omitted.

In the First Embodiment, the discharge between the charging roller 2 and the photosensitive drum 1 at the ejection sequence (time $t_4$ to time $t_6$ in FIG. 1) was ensured by the constant voltage control. For this reason, if the resistance value of the charging roller 2 falls under environments of high temperatures and high humidities, a flowing current increases even for the formation of an identical discharge electric field, so that there are occurring cases of a so-called "plus memory" phenomenon. Namely, in an image forming apparatus of the reversal developing system, on application of the reversal developing system, on application of a bias (here, positive polarity) of the ejection sequence directly from a charging roller to the surface of a photosensitive drum, the positive charge originating from the ejection bias remains on the photosensitive drum and the surface of the photosensitive drum is not charged to a preset charging potential depending on the positive charging history of the photosensitive drum using the above charging bias at the time of charging the photosensitive drum in the next image forming process, so that a phenomenon of the charging potential to lower from a normal state, i.e. a plus memory phenomenon takes place.

In this embodiment, the positive charging history of the photosensitive drum is prevented by the constant-current control of a plus discharge between the charging roller and the photosensitive drum at the ejection sequence, thus enabling a stable ejection.

FIG. 4 is a vertically sectional view showing the schematic configuration of an image forming apparatus according to the present invention. As shown in FIG. 4, a charging bias power supply 20 comprises a constant-current circuit 20*a* for applying a positive polarity current to the charging roller 2. The control of the charging bias power supply 20, the developing bias power supply 21 or the like is fulfilled by a control controller 19.

Figure 5:
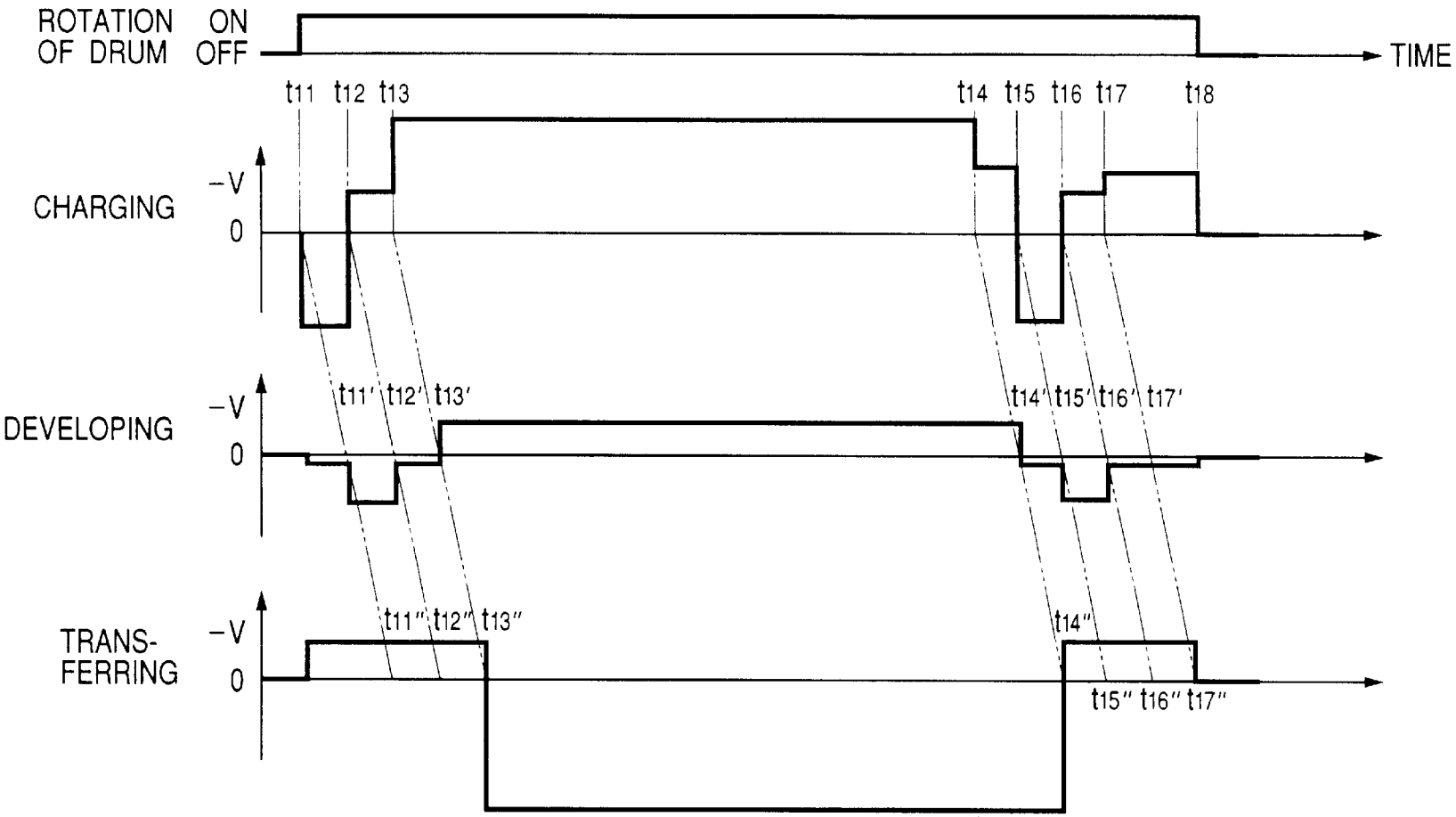
FIG. 5 is a graph showing a control sequence according to Second Embodiment.
Figure 6:
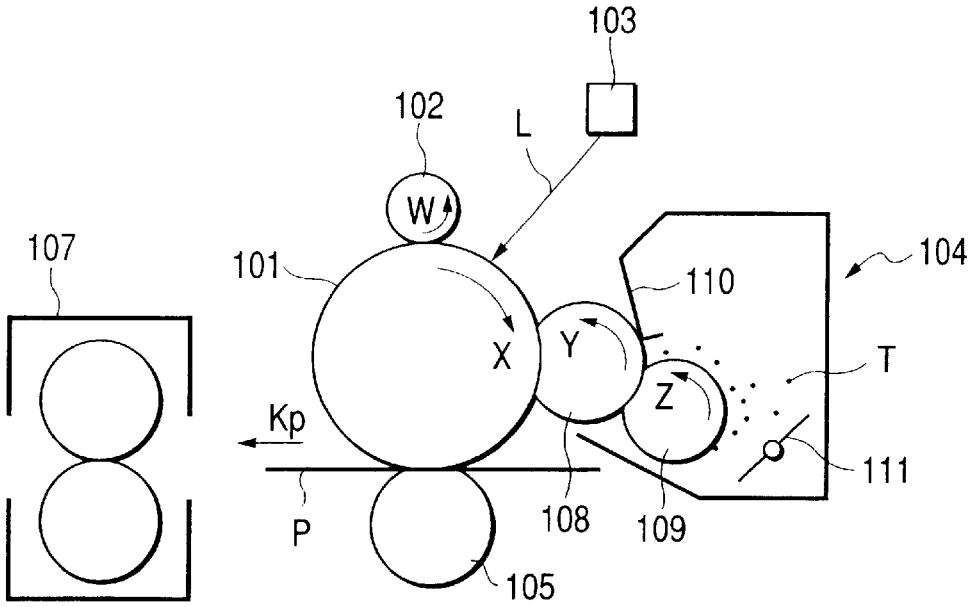
FIG. 6 is a vertically sectional view of a conventional image forming apparatus.
Figure 7A:
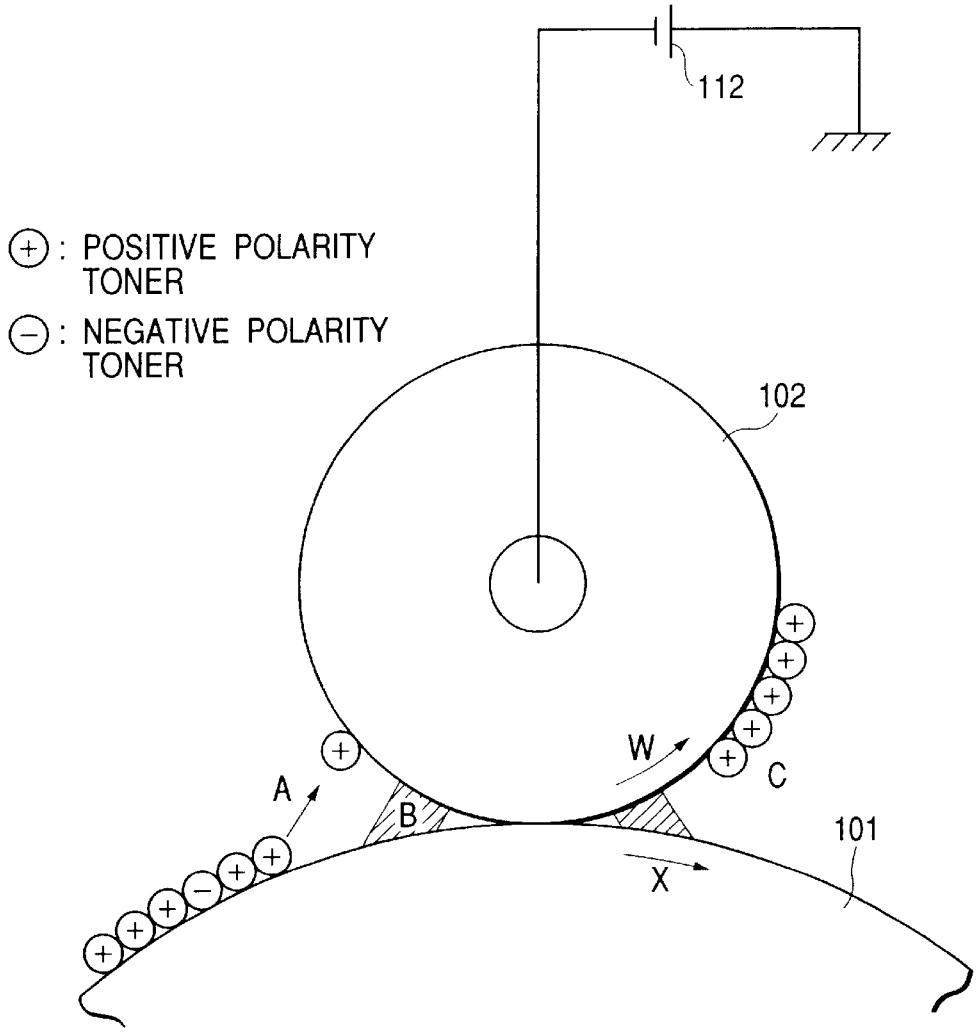
FIGS. 7A and 7B are illustrations of a sticking aspect of a toner to a charging roller in an image forming apparatus.
Figure 7B:
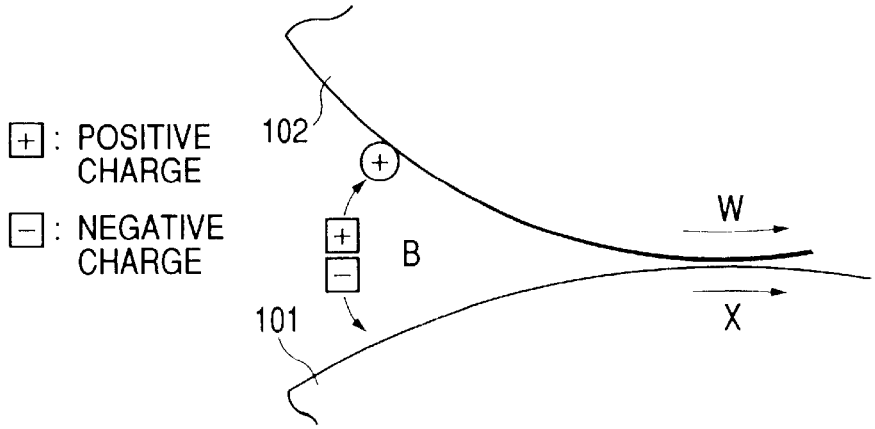

FIG. 5 is a graph showing a control sequence according to this embodiment. In this embodiment, a case of applying the control of an ejection sequence to the preparatory rotation (pre-rotation) before the image formation and the completion rotation (herein-after, referred to as "post-rotation") after the completion of image formation is shown.

First, an image signal is inputted to the image forming apparatus from a computer (unillustrated) and the photosensitive drum 1 begins to rotate by the rotation of the main motor 17 (time $t_{11}$). At this time, since a bias of approx. −700 V is applied to the photosensitive drum 1 by the charging bias power supply 20 at the post-rotation process (time $t_{17}$ to time $t_{18}$) in FIG. 5, the surface of the photosensitive drum 1 has a surface potential of approx. −100 to 0 V (approaches 0 V on account of the dark dissipation by a discharge). simultaneously to the rotation start of the photosensitive drum 1, a positive polarity bias controlled at a constant current is applied to the charging roller 2 from the charging bias power supply 12. In this embodiment, a value of current to be controlled at a constant current was set to 2 $\mu$A. Besides, the maximum voltage value in case of constant-current control was set to approx. +1300 V. This setting is provided to prevent the surface breakdown of the photosensitive drum 1.

By the constant-current control of a positive polarity bias, the toner stuck on the charging roller 2 ends in being reversed in polarity to the negative polarity as with First Embodiment. At this time, a constant-current control eliminates the positive charging history caused by a plus discharge from the surface of the photosensitive drum 1. Furthermore, the value of current applied in a constant-current control is temporarily stored into the RAM of a control controller 19.

For a period from time $t_{12}$ to time $t_{13}$, an ejection bias of approx. −400 V is applied to the charging bias by the charging bias power supply 20. At this time, since the surface potential of the opposed photosensitive drum 1 is approx. −100 to 0 V, an electric field energizing from the charging roller 2 to the side of the photosensitive drum 1 is formed for the negative polarity toner of reversal polarity on the charging roller 2. Thereby, the toner on the charging roller 2 is ejected onto the photosensitive drum 1.

For a period from time $t_{11}$ to time $t_{13}$, the ante-rotation is carried out and during this operation, the temperature adjustment of a fixing device 7, the startup of a laser scanner or the like are performed as with First Embodiment.

In the developing bias power supply 21, to prevent the sticking of a toner to the photosensitive drum 1 from the developing roller 8 at the rotation start of the photosensitive drum 1, a bias of approx. +100 V is applied to the developing roller 8 at time $t_{11}$ as with First Embodiment.

For a period from time $t_{11}'$ to time $t_{12}'$, a positive polarity bias is applied from the developing bias power supply 21. At this time, however, since the surface of the photosensitive drum 1 is subjected to a plus discharge by the charging roller 2, no one has an idea how many portions of the surface of the photosensitive drum 1 are charged. Thus, by presuming a surface potential of the photosensitive drum 1 on the basis of the applied potential at the time of constant current, stored in the RAM of the control controller 19 to determine the developing bias to be applied, the toner on the developing roller 2 is not in the least possible to be developed to the surface of the photosensitive drum 1. In this embodiment, the value obtained by adding +300 V to the applied potential for the constant current, stored in the RAM of the control controller 19, is decided to be applied to the developing roller 8 from the developing bias power supply 21.

For a period from time $t_{12}'$ to time $t_{13}'$, a bias of +100 V is applied from the developing bias power supply 21. For a period from time $t_{12}$ to time $t_{13}$, since no discharge takes place to the charging roller 2, the surface potential of the photosensitive drum 1 is kept to approx. −100 to 0 V, so that the application of +100 V to the developing roller 8 enables the toner ejected onto the photosensitive drum 1 to be collected onto the developing roller 8.

And, to the transferring roller 5, a negative polarity bias is applied as the cleaning bias from time $t_{11}$ onward as with First Embodiment. This bias is approx. −400 V, which application is made to remove the toner pollution on the transferring roller 5.

At time $t_{13}$, when the pre-rotation process ends, the image forming operation is initiated. For a period from time $t_{13}$ to time $t_{14}$, the formation of an image in response to an image signal proceeds as with First Embodiment. And, the transfer residual toner resulting from the image formation is been accumulated on the charging roller 2.

At time $t_{14}$, the image formation ends. On and after time $t_{14}$, time $t_{14}'$ and time $t_{14}''$, the post-rotation proceeds respectively.

For a period from time $t_{13}$ to time $t_{14}$, since the photosensitive drum 1 is subjected to a discharge by the transferring roller 5 at the time of the ante-rotation, the surface potential of the photosensitive drum 1 is not in a stable state. Thus, for a period from time $t_{14}$ to time $t_{15}$, the surface potential of the photosensitive drum 1 is charged to approx. −100 V by applying a bias of approx. −700 V from the charging bias power supply 20.

For a period from time $t_{14}'$ to time $t_{15}'$, a bias of approx. +100 V is applied to the developing roller 8 from the developing bias power supply 21. Thereby, the toner carried on the developing roller 8 is not in the least possible to develop the photosensitive drum 1.

With the completion of image formation, the transferring bias is ceased, a cleaning bias similar to that of the ante-rotation time continues applying instead till time $t_{17}$ (time $t_{14}''$ to time $t_{17}''$).

For a period of time $t_{15}$ to time $t_{16}$, the charging roller 2 is subjected to the constant-current control of a positive polarity bias from the charging bias power supply 20 as with the pre-rotation time and the toner stuck to the negative polarity in the end. And, as mentioned above, the value of current applied for the constant-current control is temporary stored in the RAM of the control controller 19.

For a period from time $t_{16}$ to time $t_{17}$, an ejection bias of approx. −400 V is applied to the charging roller 2 by the charging bias power supply 20. At this time, since the surface of the opposed photosensitive drum 1 is at a surface potential of approx. −100 to 0 V charged for a period time $t_{14}$ to time $t_{15}$, an electric field energizing from the charging roller 2 to the side of the photosensitive drum 1 is considered to be formed for the negative polarity toner reversed in polarity on the charging roller 2. Thereby, the toner on the charging roller 2 is ejected onto the photosensitive drum 1.

For a period from time $t_{14}'$ to time $t_{15}'$, a positive polarity bias is applied from the developing bias power supply 21. As with the above-mentioned period from time $t_{11}'$ to time $t_{12}'$, a surface potential of the photosensitive drum 1 is presumed on the basis of the applied potential at the constant-current control, stored in the RAM of the control controller 19, and the developing bias is applied.

For a period from time $t_{16}'$ to time $t_{17}'$, a bias of +100 V is applied from the developing bias power supply 21 as with the period from time $t_{12}$ to time $t_{13}$.

And, to the transferring roller 5, a negative polarity bias is applied as the cleaning bias from time $t_{14}''$ onward as with First Embodiment. This bias amounts to approx. −400 V and acts to prevent the toner pollution on the developing roller 5.

At time $t_{18}$, the transferring material P with an image formed thereon passes through a fixing device 7 or the like and the respective bias power supplies of charging, developing and transferring stop simultaneously to the completion of photosensitive drum rotation.

In this embodiment, the toner ejection sequence at the ante-rotation and at the post-rotation was described, but the present invention is not limited to this and the ejection sequence may proceed for every sheet interval or for every number of given sheets.

In this manner, the positive polarity charged transfer residual toner accumulated on the charging roller is reversed in polarity by the constant-current control of a plus discharge and is ejected onto the photosensitive drum at the next cycle, thereby enabling the polarity reversal of a toner and the toner ejection without occurrence of a plus memory.

<Third Embodiment>

In this embodiment, a cleaning sequence proceeds at the time of restart after the jamming.

Figure 8:
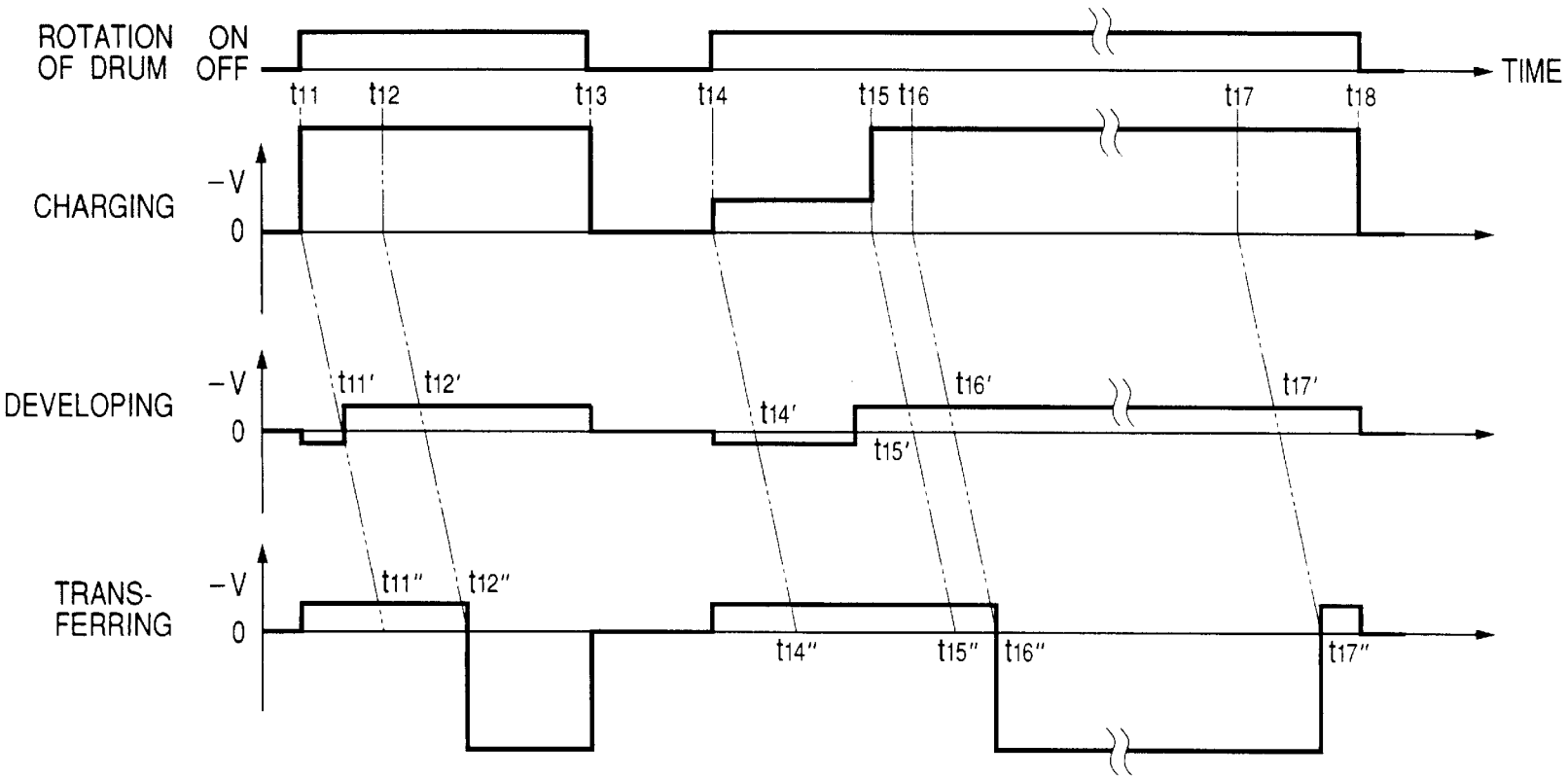
FIG. 8 is a graph showing a control sequence according to Third Embodiment.

FIG. 8 is a graph showing a recovery sequence at the jamming in an image forming apparatus.

Figure 9:
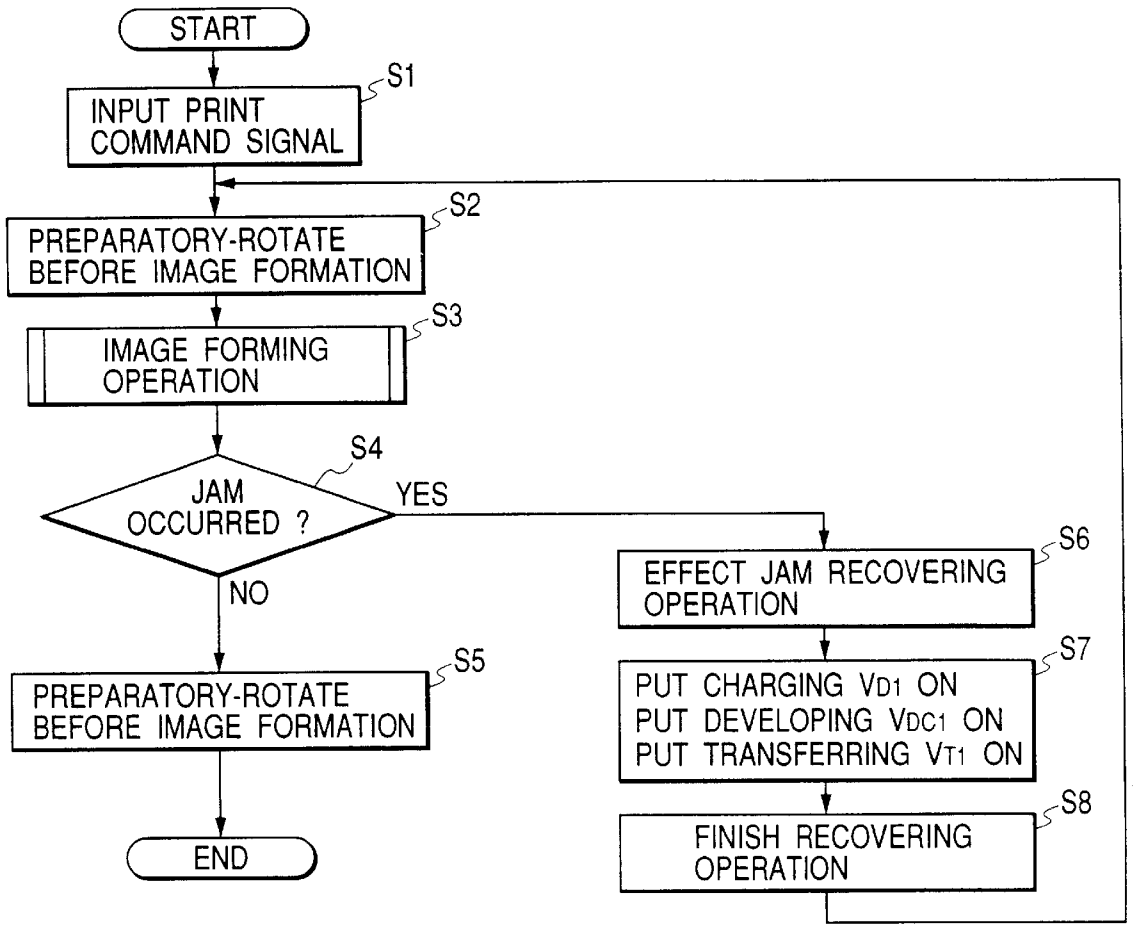
FIG. 9 is a flowchart at the occurrence of a jam in an image forming apparatus according to Third Embodiment.

Besides, FIG. 9 shows the flowchart of image formation. Here, the charging, the developing and the transferring represent the applied bias at their respective times. And, the negative polarity is taken upward. The axis of abscissas represents the lapse of time. Two-dot chain lines over the charging, the developing and the transferring represent the respective same positions on the photosensitive drum 1. And, time $t_{11}''$ is assigned to the time when the surface position of the photosensitive drum 1 situated at the nip part with the charging roller 2 at time $t_{11}$ came to the position opposed to the developing roller 8. And, similarly time $t_{11}''$ is assigned to the time when the surface position of the photosensitive drum 1 situated at the nip part with the charging roller 2 at time $t_{11}$ came to the position opposed to the transferring roller 5.

First, an image signal is inputted to the image forming apparatus from a computer (unillustrated) or the like (step 1, hereinafter, described as "S1") and the photosensitive drum 1 begins to rotate by the rotation of a main motor (time $t_{11}$). Simultaneously to this, to the charging roller 2 from the charging bias power supply 21, a charging bias (−1300 V) similar to that of the image formation time is applied. The period from time $t_{11}$ to time $t_{12}$ is provided for the preparatory rotation before the image formation (hereinafter, referred to as "pre-rotation") and the temperature adjustment of a fixing device 7, the startup of a laser scanner or the like is performed during this period (S2).

With the developing bias power supply 13, a bias of approx. +100 V is applied to the developing roller 8 at time $t_{11}$. This is because the surface potential may drop near zero and the toner on the developing roller 8 is inevitably developed if the surface potential is 0 and a developing bias of 0 V is applied.

At time $t_{11}'$, a bias of −350 V is applied from the developing bias power supply 13. At this time, since the surface of the photosensitive drum 1 is already charged to approx. −700 V, the toner carried on the roller 8 is not in the least possible to be developed.

And, to the transferring roller 5, a negative polarity bias is applied as the cleaning bias. This bias is on the order of approx. −400 V and is provided to remove the toner pollution on the transfer roller 5.

After the pre-rotation ends at time $t_{12}$, the image formation starts at time $t_{12}$ (S3). Namely, from time $t_{12}$ onward, the surface of the photosensitive drum 1 is exposed in response to an image signal and the image formation is carried out as mentioned above.

Figure 10:
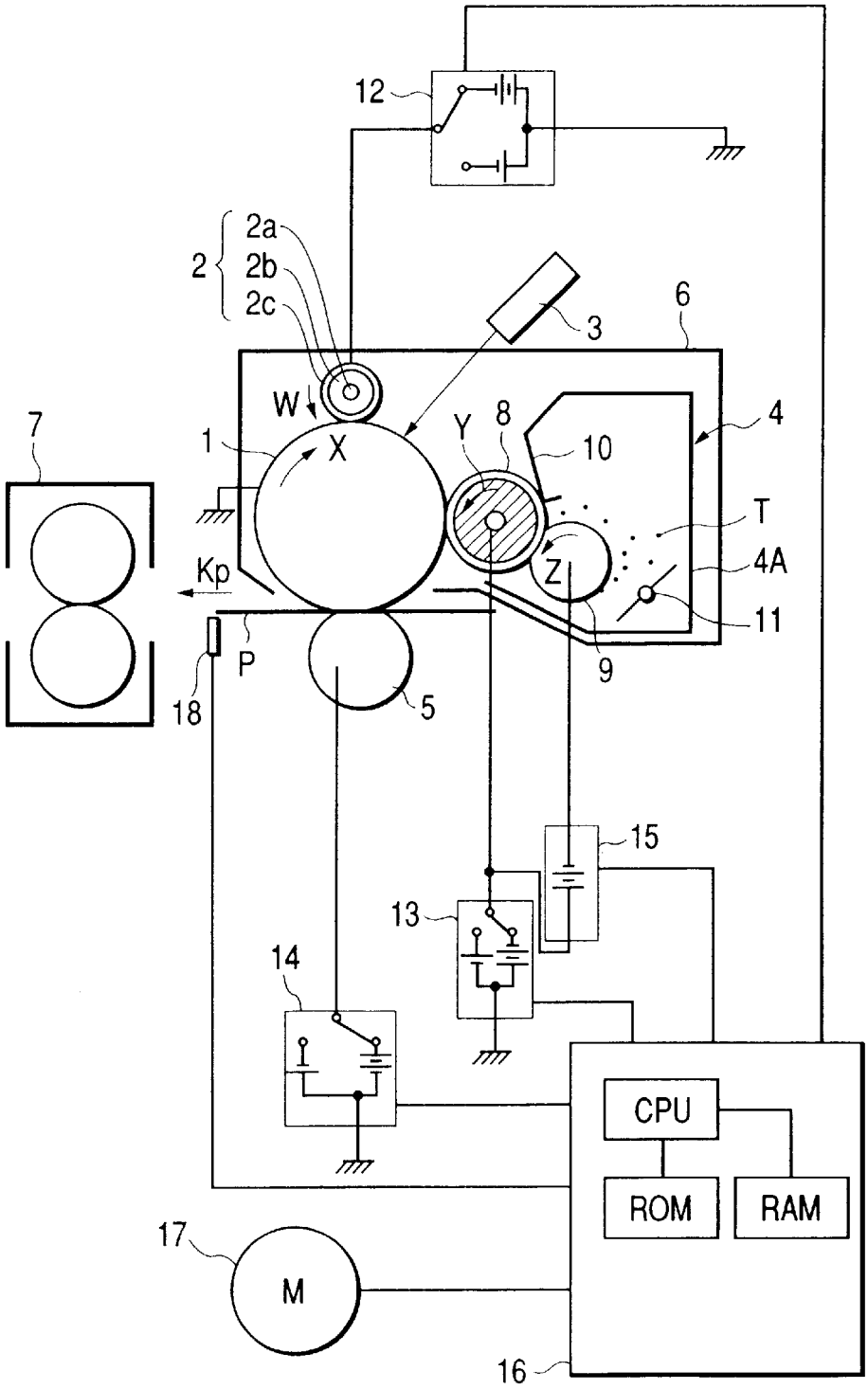
FIG. 10 is a diagram showing a schematic configuration of an image forming apparatus according to Third Embodiment.

In this embodiment, the image forming operation is forcibly stopped by the jam sensor 18 in FIG. 10 at time $t_{13}$ (S4). By this forcible stop, the voltage output is put OFF in the respective power supplies of a charging bias, a developing bias and a transferring bias. And, the jam is notified to a user.

By a user, the process cartridge 6 is demounted once from the main body of the image forming apparatus and the transferring material P is removed. At this time, the surface of the photosensitive drum 1 receives a bright ray of light (external light), thus causing the potential almost to zero.

Anew, a process cartridge 6 is mounted to the main body of the image forming apparatus, the cover (not shown) in the main body of the image forming apparatus is closed and the jam recovering operation is executed (S6, time $t_{14}$). During the jam recovering operation, a bias of approx. −300 V ($V_{D1}$ in FIG. 3) is applied to the charging roller 2 from the charging bias power supply 12 (S7).

When a great amount of toner remaining on the surface of the photosensitive drum 1 thrushes into the charging roller 2, the formation of a discharge electric field like a conventional example entailed inconveniences that (1) since the surface of the photosensitive drum 1 is not exposed on account of the presence of the toner layer, the surface of the photosensitive drum 1 cannot be charged to a desired potential; (2) the charging roller 2 is inevitably polluted; or the like. In particular, (2) is attributable to the partial reversal of the toner charging polarity under influence of a discharge on the toner on the photosensitive drum 1.

Thus, in the present invention, by applying a bias, equal in polarity to the toner (negative polarity) and not higher than the discharge threshold, to the charging roller 2 as the recovering sequence, (1) when the toner layer on the surface of the photosensitive drum 1 passes through the charging roller 2, an undischarged electric field in the direction of energizing the negative polarity toner from the charging roller 2 to the side of the photosensitive drum 1 is formed;

(2) because of not being subjected to a discharge, the toner on the photosensitive drum 1 almost comprises negative polarity charged toner components (in order to be an appropriately image formed tone); and (3) since the surface of the photosensitive drum 1 receives a right ray of light, the surface potential becomes almost zero.

Since the surface potential of the photosensitive drum 1 is approx. 0 V and a bias of −300 V is applied to the charging roller 2, the negative polarity toner passing through the charging roller 2 is energized to the side of the photosensitive drum 1 and can pass through the charging roller 2 without stuck to the charging roller 2.

At this time, as the lower limit of the applied bias, the potential difference from the photosensitive drum 1 is preferably not lower than 50 V, or in other words, a voltage of not higher than −50 V is preferably applied to the charging roller 2. This is because, in case where the potential difference of not greater than 50 V, there is the possibility that the electric field energizing the toner to the side of the photosensitive drum weakens and the toner is stuck to the charging roller 2.

In the present invention, the discharge threshold means a point where the flowing current drastically changes when gradually raising the voltage applied to the charging roller 2. Generally, the discharge threshold is on the order of approx. 600 V at normal temperatures and at normal humidities.

And, at time $t_{14}$, a collection bias ($V_{DC1}$) of approx. +100 V is applied as the developing bias to collect the negative polarity toner having passed through the charging roller 2. Since the surface potential of the photosensitive drum 1 is approx. 0 V and +100 V is applied as the developing bias, the negative polarity bias is collected into the developing roller 8.

Furthermore, at time $t_{14}$, a negative polarity bias ($V_{T1}$) is applied to the transferring roller 5 as the cleaning bias. This bias is on the order of approx. −400 V and is provided to remove the toner pollution on the transferring roller 5.

The jam recovering operation proceeds from time $t_{14}$ to time $t_{15}$. The length of the time $t_{14}$ to time $t_{15}$ preferably ensures a time required in that the surface of the photosensitive drum 1 passes from the developing position through the transferring position and then through the charging position.

At time $t_{15}$, the recovering operation ends (S8) and the ante-rotation operation is initiated (S2). To charge the surface of the photosensitive drum 1 to −700 V simultaneously to the image formation time, about −1300 V is applied to the charging roller 2, and a developing bias of −350 V is applied at time $t_{15}'$. Thereafter, the ante-rotation ends.

And, for a period from time $t_{16}$ to time $t_{17}$, the image formation is carried out as mentioned above (S3) and the post-rotation after the image formation is initiated at time $t_{17}$ (S5). And, at time $t_{18}$, the transferring material P is discharged outside the main body of the image forming apparatus and the post-rotation operation ends, so that all operations are completed.

As mentioned above, in an image forming apparatus of the cleaning simultaneous with developing type using a contact charging member (charging roller 2), a bias equal in polarity to the toner not higher than the discharge threshold is applied to a charging member for a certain term during the recovery of jamming and simultaneously a bias reverse in polarity to the toner not higher than the discharge threshold is applied to a developing member (developing roller 8) for a certain term, so that a bias energizing to the side of the photosensitive drum 1 can be applied to the untransferred toner even if a great amount of undeveloped toner thrusts into the charging member, the poor charging of the photosensitive drum 1 and the pollution of the charging member can be prevented and this toner can be collected into the developing device 4.

As individual members and a toner used in the present invention, the following are preferable.

[Surface Property of the Charging Roller]

As mentioned above, the charging roller is made by forming a 3 mm thick and low resistance conductive rubber layer 2*b* of the order of $10^4$ Ω·cm in bulk resistivity onto a 6 mm diameter conductive metal made mandrel 2*a* (see FIG. 2) and further forming a 20 to 50 μm thick and high resistance surface layer 2*c* of the order of $10^8$ Ω·cm in bulk resistivity on its peripheral surface.

As materials of a low resistance conductive rubber layer 2*b,* used rubbers such as silicone rubber, NBR (nitrile rubber), butyl rubber, natural rubber, acrylic rubber, butyl rubber, hydrine rubber and urethane rubber are usable.

As materials of a high resistance conductive rubber layer 2*c,* resin, silicone resin, polyamide resin, fluoride resin or the like are usable.

By decreasing the surface roughness in the surface layer of a charging roller 2, there is an effect of reducing the toner sticking to the charging roller 2. As the surface roughness of the charging roller 2, a 10 point average roughness Rz of 0.5 to 6 μm is preferable. This is because the manufacturing is difficult when the 10 point roughness Rz is not greater than 0.5 μm and an increase in the sticking surface of an undeveloped toner facilitates the mechanical sticking of an undeveloped toner to the charging roller 2 for a 10 point average roughness Rz of not smaller than 6 μm. Incidentally, the 10 point average roughness Rz used the definition shown in JIS B0601 and a surface roughness testing tool "SE-30H" (manufactured by Kosaka Laboratory, Ltd) was used.

By decreasing the dynamic friction coefficient μ in the surface layer of a charging roller 2, there is an effect of reducing the toner sticking to the charging roller 2. As the dynamic friction coefficient μ in the surface layer of a charging roller 2, a value of 0.01 to 0.4 is preferably used and a value of 0.02 to 0.4 is well preferable. Since manufacturing the charging roller 2 is difficult for a dynamic friction coefficient of not greater than 0.01 and by contraries the sticking of an undeveloped toner to the charging roller 2 increases for a dynamic friction coefficient μ of not smaller than 0.4, these values beyond the above limits are not preferable.

Figure 11:
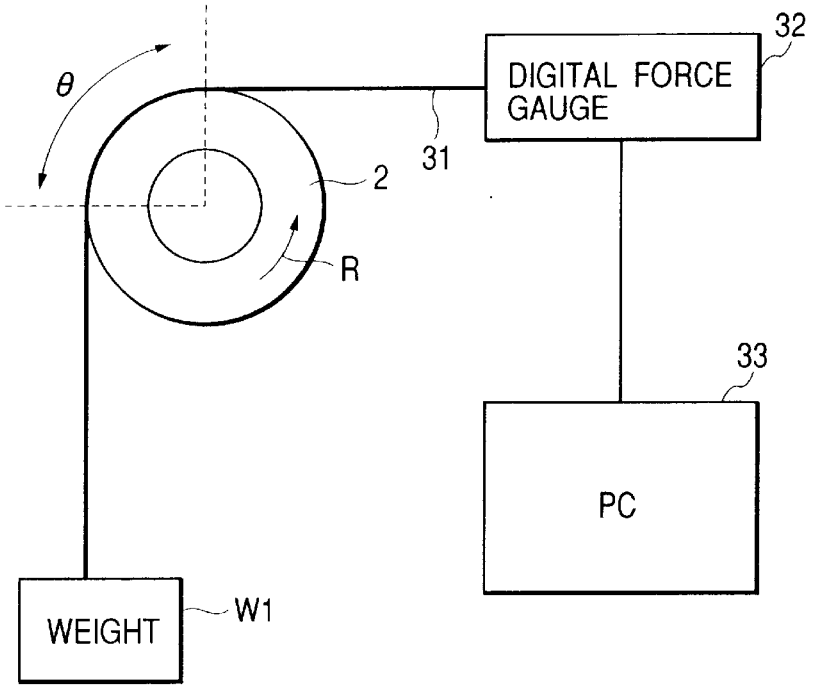
FIG. 11 is an illustration of a method for measuring a dynamic friction coefficient.

The dynamic friction coefficient μ remarked here is one measured for the surface stainless steel sheet of a charging roller 2 by the following method. The dynamic friction coefficient μ was evaluated as shown in FIG. 11. A weight W1 is loaded at one end, a 0.03 mm thick stainless steel sheet 31 linking the other end to a digital force gauge 32 is set up on the surface of the charging roller 2 and the angle θ of FIG. 11 is set to 45 degrees. The digital force gauge 32 is adjusted in advance to a value of 0 at the time of no load without a weight W1 or a stainless steel sheet 31 loaded. After the value of the digital force gauge 32 is stabilized, the charging roller 2 is rotated along the arrow R in FIG. 11 and the sliding frictional force between the charging roller 2 and the stainless steel sheet 31 at this time is measured by means of the digital force gauge 32. The measured value was evaluated by sampling the values analog outputted from the digital force gauge 32 at a frequency of 10 Hz by using a recorder, computing the sampled data in accordance with the following formula (1) by using a computer 33 and further averaging the computed values for one-turn of the charging roller 2.

$$\mu=(1/\theta)\cdot\ln(F/W) \quad (1)$$

where

μ: dynamic friction coefficient,

θ: angle spanned by the part of contact between the charging roller surface and the stainless steel sheet among the total circumference of the charging roller (90 degrees), W: sum weight of the weight W1 (100 g) and the stainless steel sheet (5 g, incidentally, sheet support member inclusive), and F: measured value of the digital force gauge.

In this embodiment, the charging roller 2 was described also in the contact charging type, but the present invention is not limited to this and, for example, a brush-shaped charging brush can be used as the charging member.

[Toner]

The toner used in this embodiment is a nonmagnetic unicomponent toner and in the sectional observation of toner particles using a transmission electron microscope (TEM), wax constituents are preferably not melted with a binder resin and dispersed like isles effectively in the shape of spheres and/or spindles. Since dispersing and incorporating wax constituents into the toner as mentioned above makes the deterioration of the toner and the pollution of an image forming apparatus preventable, a good charging property is maintained, thus enabling a toner image excellent in dot reduction to be formed over a long term. Besides, in order that wax constituents act efficiently at the time of heating, the low-temperature fixity and the offset resistance shall be satisfied.

In this embodiment, a specific method for observing the sectional surface of toner particles comprises fully dispersing toner particles in a normal-temperature setting epoxy resin, then hardening them for two days in the atmosphere at a temperature of 40° C. and dying the obtained effected matter by using triruthenium tetroxide and if necessary, triosmium tetroxide and thereafter cutting out sliced samples by using a microtome equipped with diamond teeth to observe the sectional shape of toner particles under TEM. In this embodiment, the triruthenium tetroxide dying method is preferably used to make a contrast between materials by using a somewhat difference between the used wax constituent and the resin constituting the outer shell.

Figure 12A:
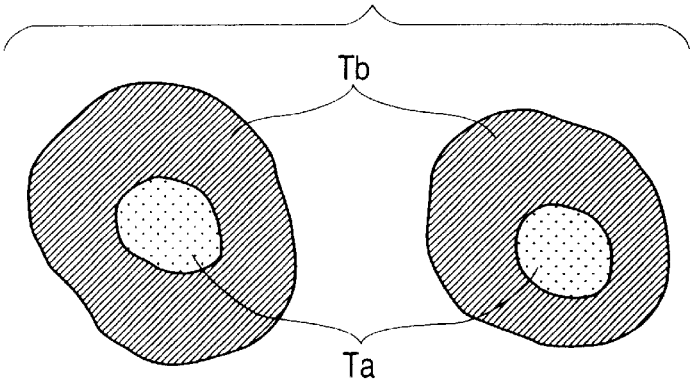
FIGS. 12A and 12B are sectional views of toner particles to be used in the present invention.
Figure 12B:
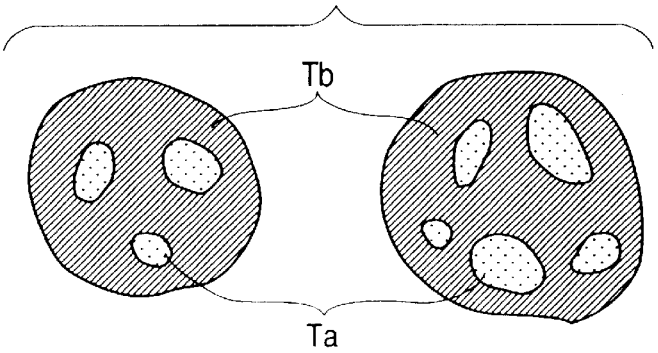

FIGS. 12A and 12B show representative examples. Toner particles used in this embodiment was observed to comprise a wax constituent Ta enclosed with an outer shell resin Tb (adhesive resin). The wax constituent Ta having a maximum endothermic peak in the range of 40 to 130° C. at a rise in temperature in the DSC curve measured by a differential scan calorimeter is used. A maximum endothermic peak present in the above temperature range effectively develops the mold releasability while greatly contributing to the low temperature fixation. If the maximum thermic peak is lower than 40° C., the self-cohesion power of the wax constituent weakens, thus resulting in worsened high-temperature offset resistance and too high gross. On the other hand, if the maximum thermic peak exceeds 130° C., the fixing temperature rises and moreover smoothing the fixed image surface moderately becomes difficult, so that this is unfavorable in view of lowered color mixture property especially in case of use for a color toner. Furthermore, the case of directly obtaining a toner by the polymerizing method after the granulation/polymerization in a watery solvent is unfavorable, because a high maximum endothermic peak temperature causes a problem that the wax constituent deposits chiefly during the granulation.

Measuring the maximum endothermic peak temperature of the wax constituent Ta is carried out according to "ASTM D 3418-8". For measurements, for example, DSC-7 manufactured by Perkin-Elmer, Co. is used. The temperature adjustment of the device detection part uses the melting points of Indium and Zinc and the fusion heat of Indium is used for the correction of heat quantity. For measuring samples, an aluminum pan is used, an empty pan is set for the control and measurement is made at a temperature-rising rate of 10° C./min after taking the pre-history by raising/lowering the temperature once. As the wax constituent, specifically, paraffine wax, polyolefine wax, Fisher Tropsch wax, amide wax, high grade fatty acid, ester wax and their derivatives or graft/block compounds of these can be used.

Toners used in the present invention are preferably ball-shaped ones. As reasons for this, a reduction of toner sticking amount due to a decrease in contact surface with the charging roller 2 by making the particle shape into a ball, the effectiveness for the scraping of the photosensitive drum 1 due to the action of a spacer-role between the photosensitive drum 1 and the charging roller 2 or the like can be referred.

Toners used in the present invention are preferably those with a shape factor SF1 of 100 to 160 and a shape factor SF2 of 100 to 140, measured by an image analyzer and well preferably those of a shape factor SF1 of 100 to 140 and a shape factor SF2 of 100 to 120. Besides, if the above conditions are satisfied and the value of (SF2)/(SF1) is set to not greater than 1.0, not only characteristics of a toner but also the matching with the image forming apparatus becomes extremely good.

With respect to SF1 and SF2 denoting the above shape factors, using FE-SEM (S-800) manufactured by Hitachi, Ltd, sampling 100 toner particles magnified at 500 times at random and introducing the image information via interface into a Nikolet, Co. available image analyzer (Luzex 3) for analysis, the values obtained by the computation according to the following formula were defined as shape factors SF1 and SF2 in this embodiment.

$$SF1=\{(MXLNG)^2/(AREA)\}\times(\pi/4)\times 100$$

$$SF2=\{(PERI)^2/(AREA)\}\times(1/4\pi)\times 100$$

where

AREA: toner projection area;

MXLNG: absolute maximum length; and

PERI: circumferential length.

The shape factor SF1 of a toner represents the degree of roundness of a toner particle, a value of 100 corresponds to a perfect sphere and the shape gradually varies from the sphere to an indefinite shape with increasing numerical values. The shape factor SF2 represents the degree of ruggedness, a value of 100 corresponds to a perfect smoothness and the ruggedness of the surface becomes significant with increasing numerical values.

When the pre-mentioned shape factor SF1 exceeds 160, the shape of a toner becomes indefinite, so that the charged quantity distribution becomes broad and moreover the toner becomes likely to adhere to the charging roller 2 strongly.

To reduce the sticking of a toner image to the charging roller 2, it is preferred that the shape factor SF2 ranges from 100 to 140 and the value of (SF2)/(SF1) is not greater than 1.0. When the shape factor SF2 of toner particles is greater than 140 and the value of (SF2)/(SF1) exceeds 1.0, the surface of toner particles is not smooth, toner particles have many protrusions and recesses and the quantity of particles stuck to the charging roller 2 increases.

It is preferable for toner particles that the weight average grain size is not greater than 10 $\mu$m (well preferably ranges from 4 to 8 $\mu$m) and the variation coefficient A in number distribution is not greater than 35%. Toner particles, smaller than 4 $\mu$m in weight average grain size is apt to be charged up and accordingly likely to adhere to the charging roller 2 strongly, so that they are unfavorable. When the weight average grain size of toner particles exceeds 10 $\mu$m, the fusion to the surface of the photosensitive drum 1 is likely to occur. When the variation coefficient in number distribution exceeds 35%, this tendency is intensified still more. The grain size distribution of toner particles can be measured by various methods. In this embodiment, a Coulter counter is used for measurements.

As the measuring instrument, for example, Coulter Counter TA-II Model (manufactured by Coulter, Inc.) is used, to which the interface (manufactured by Nikkaki, Inc) and personal computer for outputting the number distribution and the volume distribution is connected, and first-grade sodium chloride is used as the electrolyte to adjust 1% NaCl water solution. For example, ISOTONII (manufactured by Coulter Scientific Japan Co.) can be used. With respect to the measuring method, 0.1 to 5 ml of a surfactant (preferably, alkyl benzene sulfonate) is added into 100 to 150 ml of the above electrolytic water solution as the dispersant and further 2 to 20 mg of a measuring specimen is added. The electrolyte with the specimen suspended is subjected to the dispersing treatment by an ultrasonic disperser for approx. 1 to 3 min, a 100 $\mu$m aperture, for example, is used as the aperture to measure the grain size distribution of 2 to 40 $\mu$m sized particles relative to the number of particles by using the above Coulter Counter TA-IL Model and values related to Third Embodiment are evaluated from this.

The variation coefficient A in the number distribution of toner particles is calculated from the following formula.

$$A=(S/D_1)\times 100$$

In the formula, S denotes a value of standard deviation in the number distribution of toner particles and $D_1$ denotes the number average grain size ($\mu$m) of toner particles.

Furthermore, as toner particles used in this embodiment, those whose surface is covered with an external additive are preferably used so as to afford a desired charge quantity to the toner. This is because the external additive acts as the spacer by covering the toner particle surface with the external additive, thereby preventing toner particles from being stuck to the charging roller 2. In this meaning, the coating ratio of the toner surface with an external additive ranges preferably from 5 to 99% and well preferably from 10 to 99%.

To measure the coating ratio of the toner surface with an external additive, a FE-SEM (S-800) manufactured by Hitachi, Ltd is used, 100 toner particles are sampled at random and the image information is introduced via interface into an image analyzer (Luzex 3) manufactured by Nicolet Japan Corporation. Since the luminosity differs between the toner particle surface part and the external additive part, the obtained image information is digitalized, the area $S_G$ of the external additive part and the area $S_T$ of the toner particle part (area of the external additive part inclusive) are separately evaluated and the coating ratio is calculated according to the following formula.

$$\text{External Additive Coating Ratio}=(S_G/S_T)\times 100$$

The external additive used in this embodiment preferably has a grain diameter of not greater than 1/10 of the weight average diameter of toner particles from the standpoint of durability at the time of addition to the toner. This additive grain diameter means the average grain diameter evaluated from the surface observation of toner particles in an electron microscope. As external additives, for example, the following are used.

Metal oxides such as aluminum oxide, titanium oxide, strontium titanate, cerium oxide, magnesium oxide, chromium oxide, tin oxide and zinc oxide; nitride such as silicon nitride; carbides such as silicon carbide; metallic salts such as calcium sulfate, barium sulfate and calcium carbonate; fatty acid metallic salts such as zinc stearinate and calcium stearate; carbon black; silica; or the like.

Of these external additives, 0.01 to 10 parts by weight are used and preferably 0.05 to 5 parts by weight are used relative to 100 parts by weight of toner particles. These external additives may be singly used or jointly used. Those subjected to hydrophobic treatment are preferable for each of them.

If the added amount of an external additive is smaller than 0.01 by weight, the fluidity of a unicomponent developer worsens, the efficiency of transferring and developing lowers, the uneven density of an image occurs and scattering of a toner around the image part or so-called scattering occurs.

On the other hand, if the quantity of external additives exceeds 10 by weight, an excess of external additives are stuck to the photosensitive drum 1 or the developing roller 8, thereby worsening the charging property to the toner or confusing an image.

As mentioned above, in an image forming apparatus of the cleaning simultaneous with developing type using a contact charging member (charging roller 2), a bias equal in polarity to the toner not higher than the discharge threshold is applied to a charging member for a certain term during the recovery of jamming and simultaneously a bias reverse in polarity to the toner not higher than the discharge threshold is applied to a developing member (developing roller 8) for a certain term, so that a bias energizing to the side of the photosensitive drum 1 can be applied to the untransferred toner even if a great amount of undeveloped toner thrusts into the charging member, the poor charging of the photosensitive drum 1 and the pollution of the charging member can be prevented and this toner can be collected into the developing device 4.

<Fourth Embodiment>

Figure 13:
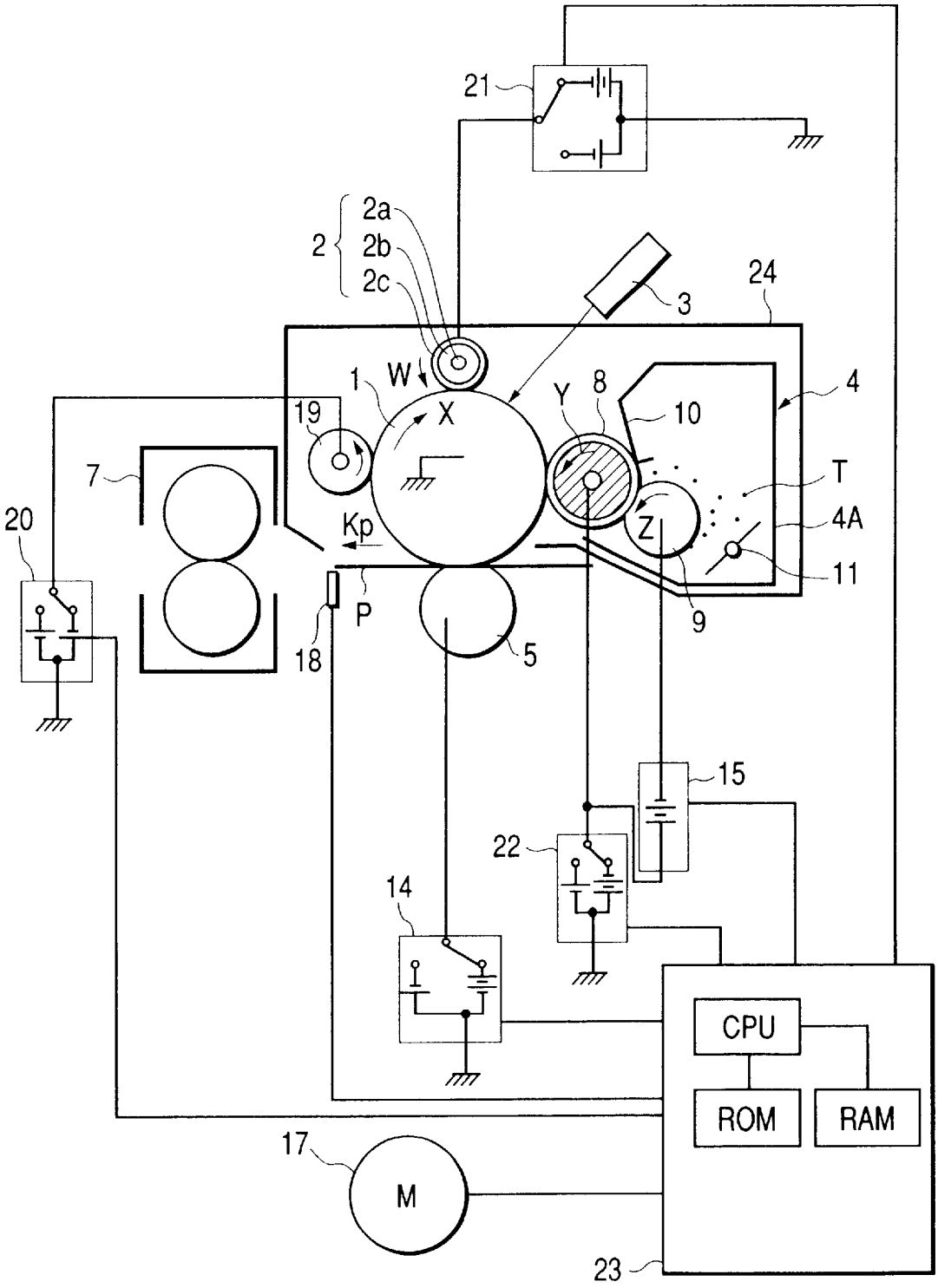
FIG. 13 is a diagram showing a schematic configuration of an image forming apparatus according to Fourth Embodiment.

Referring to FIG. 13, a Fourth Embodiment will be described. With respect to members of construction/function similar to those of First Embodiment, like symbols are attached and the description thereof is omitted.

In this embodiment, the case of having a toner scattering member 19 as auxiliary member provided between the transferring roller and the charging roller to prevent a ghost during the image formation will be described.

FIG. 13 is a sketchy structure diagram of an image forming apparatus according to this embodiment. Numeral 19 in FIG. 13 denotes a toner scattering member. In this embodiment, the toner scattering member 19 is made of a sponge roller and rotates toward the arrow R19 to the photosensitive drum 1 rotating toward the arrow X. To control the toner scattering member 19, a scattering bias power supply 20 is connected. The control of the scattering bias power supply 20, the charging bias power supply 21, the developing bias power supply 22 or the like is accomplished by a control controller (control means) 23.

Figure 14:
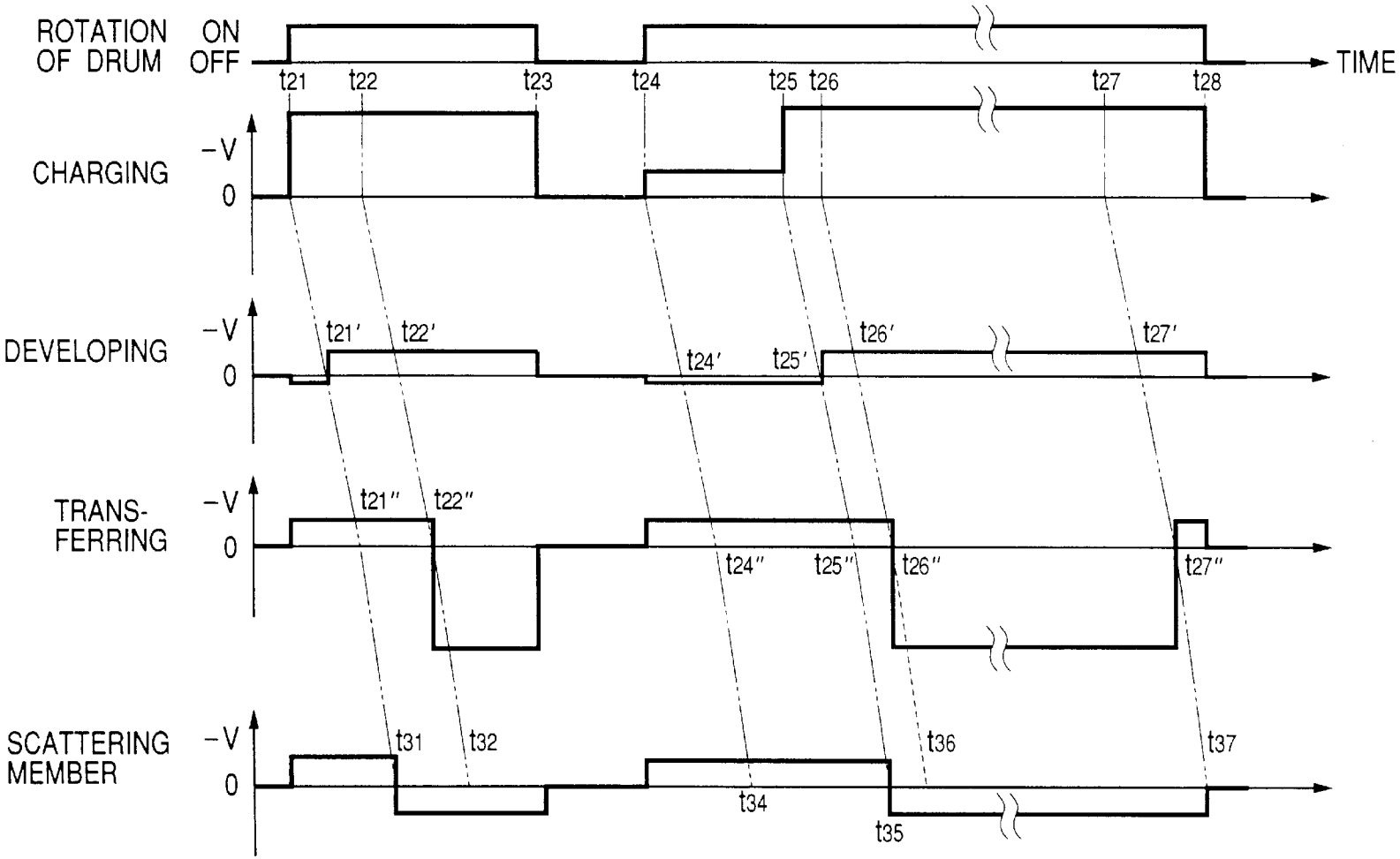
FIG. 14 is a graph showing a control sequence according to Fourth Embodiment.

FIG. 14 is a graph showing a control sequence according to this embodiment.

With respect to times of the toner scattering member 19 (scattering member) in relation to denotations of the time axis, time $t_{31}$ is assigned when the surface position of the photosensitive drum 1 situated at the nip part with the charging roller 2 at time $t_{21}$ came at a position opposed to the toner scattering member 19 after a lapse of the time.

First, to the image forming apparatus, an image signal is inputted from a computer (unillustrated) or the like and the photosensitive drum 1 begins to rotate by the rotation of a main motor 17 (time $t_{12}$). Simultaneously with this, a charging bias (−1300 V) similar to that of the image formation time is applied to the charging roller 2 from the charging bias power supply 21. For a period from time $t_{21}$ to the time $t_{22}$, the preparatory rotation before the image formation proceeds and during this operation, the temperature adjustment of a fixing device 7, the startup of a laser scanner or the like are carried out. At this time, a negative polarity bias is applied to the scattering member 19 and toner ejection is performed.

In the developing bias power supply 22, a bias of approx. +100 V is applied to the developing roller 8 at time $t_{21}$. This is because the surface potential may drops near zero on account of the dark decay of the photosensitive drum 1 between the charging roller 2 and the developing roller 8 and the toner on the developing roller 8 may be inevitably developed if the surface potential is zero and a developing bias of 0 V is applied.

At time $t_{21}'$, a bias of −350 V is applied from the developing bias power supply 22. At this time, since the surface of the photosensitive drum 1 is already charged to approx. −700 V, the toner carried on the developing roller 8 is not in the least possible to be developed.

And, to the transferring roller 5, a negative polarity bias is applied as the cleaning bias. This bias is on the order of approx. −400 V and applied to remove the toner pollution on the transferring roller 5. At this time, a negative polarity bias (−300 V) is applied to the toner scattering material 19 to perform the toner ejection. At time $t_{31}$, a positive polarity bias (+300 V) is applied to the toner scattering material to perform the toner capture and scattering.

After the ante-rotation ends at time $t_{22}'$, the image forming duration starts at time $t_{22}$. Namely, from time $t_{22}$ onward, the surface of the photosensitive drum 1 is exposed to light in accordance with the image signal and the image formation is carried out as mentioned above.

At time $t_{23}$, the image forming operation is forcibly stopped by the jam sensor 18. By this forcible stop, the voltage output is put OFF in the respective power supplies of a charging bias, a developing bias, a toner scattering bias, and a transferring bias. And, the jam is notified to a user.

By the user, the process cartridge 24 is demounted once from the main body of the image forming apparatus and the transferring material P is removed. At this time, the surface of the photosensitive drum 1 receives a bright ray of light, thereby bringing the potential to almost zero.

Anew, the process cartridge 24 is mounted to the main body of the image forming apparatus, the cover (unillustrated) in the main body of the image forming apparatus is closed and the jam recovering operation is executed (time $t_{24}$). During the jam recovering operation, a bias of approx. −300 V is applied to the charging roller 2 from the charging bias power supply 21.

Simultaneously with this, a negative polarity bias is applied to the toner scattering material 19 and the toner accumulated during the image formation is transferred to the photosensitive drum 1. After the transfer of a toner from the toner scattering member 19 ends, the untransferred toner remaining on the photosensitive drum 1 reaches the charging roller 2 in turn.

Since the surface potential of the photosensitive drum 1 is approx. 0 V and a bias of −300 V is applied to the charging roller 2, the negative polarity toner passing through the charging roller 2 is energized toward the side of the photosensitive drum 1 and can pass through the charging roller 2 without stuck to the charging roller 2. In this embodiment, the bias applied to the charging roller 2 is set to a constant voltage, but the stuck quantity of the untransferred toner can be detected to increase/decrease the applied bias corresponding to the detected result. As a method for detecting the stuck quantity of the untransferred toner, a method comprising adding up the number of printing pixels, for example, from computer signals or the like is available.

And, at time $t_{24}$, a collection bias of approx. +100 V is applied to collect the negative polarity toner coming through the charging roller 2. Since the surface potential of the photosensitive drum 1 is approx. 0 V and a bias of +100 V is applied as the developing bias, the untransferred toner on the toner scattering member 19 and the photosensitive drum 1 is collected onto the developing roller 8.

Furthermore, at time $t_{24}$, a negative polarity bias is applied to the transferring roller 5 as the cleaning bias. This bias is on the order of approx. −400 V and is provided to remove the toner pollution on the transferring roller 5.

The jam recovering operation proceeds from time $t_{24}$ to time $t_{25}$. The length of time $t_{24}$ to time $t_{25}$ preferably ensures a time required in that the surface of the photosensitive drum 1 passes from the developing position through the transferring position and then through the charging position.

At time $t_{25}$, the recovering operation ends and the ante-rotation operation is initiated. To charge the surface of the photosensitive drum 1 to −700 V simultaneously with the image formation time, about −1300 V is applied to the charging roller 2, and a developing bias of −350 V is applied at time $t_{15}'$. A capture bias is applied to the toner scattering member 19 and the ante-rotation ends.

And, for a period from time $t_{26}$ to time $t_{27}$, the image formation is carried out as mentioned above (S3) and the post-rotation after the image formation is initiated at time $t_{27}$ (S5). And, at time $t_{28}$, the transferring material P is discharged outside the main body of the image forming apparatus and the post-rotation operation ends, so that all operations are completed.

As mentioned above, in an image forming apparatus of the cleaning simultaneous with developing type using a contact charging member, a bias equal in polarity to the toner not higher than the discharge threshold is applied to a charging member (charging roller 2) for a certain term during the recovery of jamming and moreover a bias reverse in polarity to the toner not higher than the discharge threshold is applied to a developing member (developing roller 8) for a certain term, so that a bias energizing toward the side of the photosensitive drum 1 can be applied to the untransferred toner even if a great amount of untransferred toner and the toner captured by the toner scattering member thrusts into the charging member, thereby enabling the poor charging of the photosensitive drum 1 and the pollution of the charging member to be prevented and this toner to be collected into the developing device 4.

As described, in an image forming apparatus of the cleaning simultaneous with developing type using a charging member disposed in contact with an image bearing body, a bias equal in polarity to the toner not higher than the discharge threshold is applied to a charging member for a certain term during the recovery of jamming and thereafter a bias reverse in polarity to the toner not higher than the discharge threshold is applied for a certain term, so that a bias energizing toward the side of the photosensitive drum 1 can be applied to the untransferred toner even if a great amount of untransferred toner thrusts into the charging member via the image bearing body, thereby enabling the poor charging of the photosensitive drum 1 and the pollution of the charging member to be effectively prevented.

In conclusion, the embodiments of the present invention were described, the present invention is not limited to these embodiments and all modifications and changes within the technical ideas may be made.

What is claimed is:

1. An image forming apparatus, comprising:

an image bearing body for bearing a toner image;

transferring means for transferring a toner image on said image bearing body to a transferring material;

a charging member for charging said image bearing body having a residual toner after the transfer on a surface thereof by being brought into contact therewith;

electrostatic image forming means for forming an electrostatic image on said image bearing body charged by said charging member;

developing means for collecting the residual toner on said image bearing body while developing the electrostatic image on said image bearing body by using a toner charged in the same polarity as a charging polarity generated by said charging member; and control means for controlling a voltage to be applied to said charging member, wherein a cleaning sequence is effected by controlling the voltage by said control means, and, in said cleaning sequence, the toner being returned from said charging member to said image bearing body by applying a voltage, which has a same polarity as a normal polarity of the toner and is not higher than a discharge threshold value, to said charging member, after a voltage, which has a polarity opposite to the normal polarity of the toner and is higher than the discharge threshold value, is applied to said charging member, when an image formation is not effected.

2. An image forming apparatus according to claim 1, wherein the cleaning sequence is performed for a preparatory period performed before the image formation.

3. An image forming apparatus according to claim 1, wherein the cleaning sequence is performed for a post-processing period performed after the image formation.

4. An image forming apparatus according to claim 1, wherein the cleaning sequence is performed between the image formation and the image formation in a succession of image formation.

5. An image forming apparatus according to claim 1, wherein the cleaning sequence is performed at a restart of said apparatus.

6. An image forming apparatus according to claim 1, wherein the discharge voltage reverse to the polarity of the toner, to be applied during the cleaning sequence, is a voltage controlled so that a constant current is effected.

7. An image forming apparatus according to claim 1, wherein said developing means includes a toner carrying body being in contact with said image bearing body.

8. An image forming apparatus according to claim 1, further comprising a distorting member for distorting a residual toner image, said image forming apparatus being provided at an upper stream side in a moving direction of said image bearing body from said charging member.

9. An image forming apparatus according to claim 1, wherein said charging member is formed by a roller shape and dynamic friction coefficient of a surface of said charging member is in the range of 0.01 to 0.4.

10. An image forming apparatus according to claim 1, wherein a shape factor SF1 of the toner is in the range of 100 to 160 and a shape factor SF2 of the toner is in the range of 100 to 140.

11. An image forming apparatus, comprising:

an image bearing body;

a charging member, provided to be in contact with said image bearing body, for charging said image bearing body;

developing means for developing an electrostatic image formed on said image bearing body with a developer having a same polarity as a charging polarity of said charging member, said developing means being capable of collecting a residual toner on said image bearing body; and control means for controlling a voltage to be applied to said charging member, wherein a cleaning period for cleaning the toner from said charging member to said image bearing body is provided during an area that becomes a nonimage area of said image bearing body exists at a contact portion between said image bearing body and said charging member, and wherein, in the cleaning period, said control means applies a voltage, which has a same polarity as a normal polarity of the toner and is not higher than a discharge threshold value, to said charging member, after a voltage, which has a polarity opposite to the normal polarity of the toner and is higher than the discharge threshold value, is applied to said charging member.

12. An image forming apparatus according to claim 11, wherein the cleaning period is present in an image formation preparatory period before during an image area that becomes an image area of said image bearing body is existed at said contact portion.

13. An image forming apparatus according to claim 11, wherein the cleaning period is present in a period after during an image area that becomes an image area of said image bearing body is formed at said contact portion.

14. An image forming apparatus according to claim 11, wherein the cleaning period occurs during a time when an area between a first area that becomes an image area on said image bearing body and a second area that becomes a next image area is formed at said contact portion.

15. An image forming apparatus according to claim 11, wherein the cleaning period is effected in restarting said apparatus.

16. An image forming apparatus according to claim 11, wherein the voltage higher than the discharge threshold value is a voltage that is constant current controlled.

17. An image forming apparatus according to claim 11, wherein said developing means includes a toner carrying body provided to be in contact with said image bearing body.

18. An image forming apparatus according to claim 11, further comprising a distorting member a residual toner image, said image forming apparatus being provided at an upper stream side in a moving direction of said image bearing body from said charging member.

19. An image forming apparatus according to claim 11, wherein said charging member is formed by a roller shape and dynamic friction coefficient of a surface of said charging member is in the range of 0.01 to 0.4.

20. An image forming apparatus according to claim 11, wherein a shape factor SF1 of the toner is in the range of 100 to 160, and a shape factor SF2 of the toner is in the range of 100 to 140.

21. An image forming apparatus according to claim 11, wherein said developing means is capable of collecting the residual toner on said image bearing body while developing.

22. An image forming apparatus according to claim 11, further comprising transferring means for transferring a toner image from said image bearing body to a transferring material.

23. An image forming apparatus according to claim 11, wherein a voltage that has a same polarity as the normal polarity of the toner and is higher than the discharge threshold value is applied to said charging member during a time when an area that becomes an image area of said image bearing body is formed at the contact portion.

24. An image forming apparatus according to claim 11, wherein an adhesion of the toner from said developing means to said image bearing body is prevented by applying a voltage having a polarity opposite to that in developing to said developing means in accordance with an area of said image bearing body, to which the voltage having a polarity opposite to the normal polarity of the toner and being higher than the discharge threshold value is applied by said charging member.

25. An image forming apparatus according to claim 11, wherein a voltage for collecting the toner having normal plurality from said image bearing body to said developing means is applied in accordance with an area of said image bearing body, to which the voltage having a same polarity as the normal polarity of the toner and being not higher than the discharge threshold value is applied by said charging member.

* * * * *

UNITED STATES PATENT AND TRADEMARK OFFICE

CERTIFICATE OF CORRECTION

PATENT NO. : 6,438,331 B2
DATED : August 20, 2002
INVENTOR(S) : Katsuhiro Sakaizawa et al.

It is certified that error appears in the above-identified patent and that said Letters Patent is hereby corrected as shown below:

Column 2,
Line 44, “simultaneous” should read -- simultaneously --;
Line 46, “neous” should read -- neously --; and
Line 52, “neous” should read -- neously --.

Column 5,
Line 5, “simultaneous” should read -- simultaneously --; and
Line 18, “neous” should read -- neously --.

Column 7,
Line 8, “of” should be deleted.

Column 9,
Line 12, “without” should read -- without being --.

Column 11,
Line 10, “control” should be deleted;
Line 26, “simultaneously” should read -- ¶Simultaneously --; and
Line 43, “control” should be deleted.

Column 12,
Line 27, “been” should be deleted; and
Line 54, “temporary” should read -- temporarily --.

Column 14,
Line 65, “without” should read -- without being --.

Column 16,
Line 2, “used” should read -- commonly used --;
Line 20, “Ltd)” should read -- Ltd.) --; and
Line 28, “contraries” should read -- contrast --.

Column 18,
Line 18, “Ltd,” should read -- Ltd., --.

Column 19,
Line 1, “Inc)” should read -- Inc.) --; and
Line 37, “Ltd” should read -- Ltd. --.

UNITED STATES PATENT AND TRADEMARK OFFICE

CERTIFICATE OF CORRECTION

PATENT NO. : 6,438,331 B2
DATED : August 20, 2002
INVENTOR(S) : Katsuhiro Sakaizawa et al.

It is certified that error appears in the above-identified patent and that said Letters Patent is hereby corrected as shown below:

Column 21,
Line 5, “drops” should read -- drop --; and
Line 58, “without” should read -- without being --.

Column 22,
Line 59, “the” (first occurrence) should be deleted; and
Line 60, “were described” should read -- have been described, however, --.

Signed and Sealed this

Thirty-first Day of December, 2002

JAMES E. ROGAN
*Director of the United States Patent and Trademark Office*